US007699178B2

(12) United States Patent
Kato et al.

(10) Patent No.: US 7,699,178 B2
(45) Date of Patent: Apr. 20, 2010

(54) PARTICULATE SIFTER

(75) Inventors: Fumio Kato, Aichi (JP); Teruo Inoue, Aichi (JP); Yoshio Sakakibara, Aichi (JP); Sinsaku Kamimura, Aichi (JP)

(73) Assignee: Tsukasa Industry Co., Ltd., Handa-Shi Aichi (JP)

( * ) Notice: Subject to any disclaimer, the term of this patent is extended or adjusted under 35 U.S.C. 154(b) by 584 days.

(21) Appl. No.: 10/598,131

(22) PCT Filed: Apr. 22, 2005

(86) PCT No.: PCT/JP2005/007725

§ 371 (c)(1),
(2), (4) Date: Aug. 18, 2006

(87) PCT Pub. No.: WO2005/102543

PCT Pub. Date: Nov. 3, 2005

(65) Prior Publication Data

US 2009/0020460 A1 Jan. 22, 2009

(30) Foreign Application Priority Data

Apr. 23, 2004 (JP) ..... 2004-129059

(51) Int. Cl.
*B07B 1/22* (2006.01)
*B07B 1/24* (2006.01)

(52) U.S. Cl. ..... 209/288; 209/293; 209/296

(58) Field of Classification Search ..... 209/284, 209/288, 293, 296–298
See application file for complete search history.

(56) References Cited

U.S. PATENT DOCUMENTS 3,233,836 A * 2/1966 Merges ..... 241/60
4,507,202 A * 3/1985 Nord et al. ..... 210/391
5,458,246 A * 10/1995 Thom, Jr. ..... 209/300
5,507,396 A * 4/1996 Hauch ..... 209/399
5,733,450 A * 3/1998 Langner ..... 210/403
6,016,921 A * 1/2000 Hauch ..... 209/399
6,305,552 B1 * 10/2001 Coleman ..... 209/664

FOREIGN PATENT DOCUMENTS

EP 06969662 A1 2/1996

(Continued)

*Primary Examiner*—Patrick H Mackey
*Assistant Examiner*—Mark Hageman
(74) *Attorney, Agent, or Firm*—Rodman & Rodman

(57) ABSTRACT

The purpose of the invention is to prevent accumulation of particulates on the outside of a net body of a particulate sifter having a cylindrical net body and to extend the lifetime of the net body. To achieve the purpose, in a particulate sifter which is provided with a sieve 21 having a cylindrical net body 26 extending in a horizontal direction and a booster having rotating blades which rotate along the inner surface of the net body 26 and which separates particulates that pass through the net body 26 from particulates and/or foreign substances that do not pass through the net body 26 while agitating the particulates that have flowed inside the sieve 21 with the booster, the sieve 21 is located rotatably around the central axis of the cylindrical net body 26. The sieve 21 may be rotated forcibly by an electric motor as a driving source or may be rotated by kinetic energy of particulate-air mixture agitated by rotating blades without a driving source.

3 Claims, 20 Drawing Sheets

FOREIGN PATENT DOCUMENTS

| | | | |
|---|---|---|---|
| FR | 2651694 | A1 | 3/1991 |
| JP | 59-39492 | | 11/1984 |
| JP | 2001-70885 | | 3/2001 |
| JP | 2001-286823 | | 10/2001 |
| JP | 3492676 | | 2/2004 |

* cited by examiner

Sieve 21 Seen from the Direction of the Arrow B in Fig. 5

(a)

(b)

PARTICULATE SIFTER

TECHNICAL FIELD

The present invention relates to a particulate sifter used for classification of particulates according to their particulate size or for removal of foreign substances from particulates such as powder, grain, particle.

BACKGROUND ART

As shown in FIG. 20, such prior art particulate sifters as disclosed, for example, in Patent Document 1 include a casing X1 into which particulates flow, a cylindrical net body X2 fixed inside the casing X1 and rotating blades X3 rotating inside the net body X2. In these particulate sifters, particulates which have flowed into the net body X2 as indicated by an arrow X4 are separated into particulates that can pass through the net body X2 and particulates and/or foreign substances that cannot pass through the net body X2 while being agitated by the rotating blades X3.

Patent Document 1: Japanese Patent Laid-Open Gazette No. 2001-70885

DISCLOSURE OF THE INVENTION

Problems to be Resolved by the Invention

However, in the above mentioned prior art particulate sifters, the net body X2 is fixed inside the casing X1. This structure causes gradual accumulation of particulates on the outside of the net body X2 as shown by X5 in FIG. 20 when the sifters are operated during long period. This results in various problems as shown in (1) to (4) below.

(1) Noxious microorganisms might grow in the accumulated particulates. Recently, compliance with the Good Manufacturing Practice (GMP) standard has been highly demanded in order to achieve the goals of the HACCP plans of which principle is total management for safety and health in (food) manufacturing processes. The potential of the growth of microorganisms is a factor that inhibits the achievement of the Good Manufacturing Practice standard.

(2) The portion of the net body X2 on which particulates accumulate is clogged. This leads to a reduced effective shifting area of the net body X2, and thus results in a reduced performance (amount of particulates that can be shifted per unit time) of the net body X2.

(3) The amount of the particulates that flow out of the particulate sifters becomes less than the amount of the particulates that flow into the sifters by the amount of accumulation. This is a problem, particularly, when the particulates that flow into the sifters have been already measured. In such cases, particulates of an amount that is different from measured amount will flow out.

(4) Accumulated particulates inhibit fluidization of the particulates, and thus reduce performance of the net body X2. Particularly, in the cases of particulates having a low flowability or a high cohesiveness, such as particulates including much oil, proper shifting will be difficult because much of the particulates having a particulate size that should pass through the net body X2 would not pass through the net body X2.

Additionally, in particulate sifters having a cylindrical net body X2 as mentioned above, density distribution of particulates inside the net body X2 is not uniform. Portion of the net body X2 with high particulates density gets a great strain while portion of the net body X2 with rather low particulates density gets a small strain. Accordingly, particular portion with a great strain wears down harder than other portion. This causes the short lifetime of the net body X2.

Considering the problems described above, the purpose of the present invention is to prevent accumulation of the particulates on the outside of a net body used in a particulate sifter having a cylindrical net body and to extend the lifetime of the net body.

Means of Solving the Problems

To achieve the above purposes, an invention disclosed in claim 1 provides a particulate sifter which are comprised of a casing (10, 20, 110, 120, 210, 220) into which particulates flow, a cylindrical net body (26, 126, 226) extending horizontally in the casing and rotating blades (23, 123, 223) which rotate along the inner surface of the net body and which separates particulates that pass through the net body from particulates and/or foreign substances that do not pass through the net body by agitating particulates that have flowed into the net body with said rotating blades, characterized in that the net body is located rotatably around the central axis of the cylindrical net body.

An invention disclosed in claim 2 is characterized in that the net body is supported by a supporting member (45, 245) and the net body is rotated forcibly by means of an electric motor (45M, 145M, 245M) as a drive source.

An invention disclosed in claim 3 is characterized in that a rotating structure is composed of the net body, a first ring member (27, 227) supporting one of the two end portions of the net body located upstream side of the particulate flow, a second ring member (28, 228) supporting another of the two end portions of the net body located downstream side of the particulate flow, and multiple rods (29, 229) connecting the first ring member and the second ring member, and the whole rotating structure rotates along with the net body.

An invention disclosed in claim 4 is characterized in that the rotating structure is supported rotatably in a way that the first ring member is supported by a supporting member (45, 245).

An invention disclosed in claim 5 is characterized in that the second ring member is provided with a frame (28*a*) in its inner area and a supported part (28*b*) located at the rotation center of the net body, the casing is provided with an opening (20*e*) used for taking the net body out of the casing formed at a portion of the casing facing to the second ring, a cover member (25) used for opening and closing the opening is provided with a supporting part (25*e*) which supports the supported part, and the rotating structure is supported rotatably in a way that the supporting part supports the supported part rotatably.

An invention disclosed in claim 6 is an particulate sifter in accordance with claim 5 characterized in that the electric motor (245M) is provided on the outer surface of the cover member (225), the supporting part is realized as the driving shaft (245*e*) of the electric motor, the driving shaft (245*e*) and the frame (228*a*) are provided with respective locking parts (253, 252), and said electric motor (245M) rotates the net body (226) by lock function of the locking parts.

Reference numbers in parentheses in the above phrases about the means are written to show correspondence between the above means and the concrete measures described in the following embodiments.

Advantageous Effect of the Invention

In an invention disclosed in claim 1, a net body is located rotatably. This structure can inhibit the accumulation of particulates on the outside of the net body, thus avoiding a growth of microorganisms, preventing a reduced performance of the net body, reducing a loss of measured particulates and facilitating a proper shifting of particulates having low flowability or high cohesiveness. Additionally, portions with big strain in the net body move with rotation of the net body. This can prevent local wearing of a particular portion in the net body. A longer lifetime of the net body can be thus obtained in this structure.

In realizing an invention disclosed in claim 1, a net body may be rotated by means of an electric motor as a driving source as described in claim 2 or may be rotated by kinetic energy of particulate-air mixture agitated by rotating blades or may be rotated by frictional force between particulates and the net body instead of a drive source. In an embodiment without a driving source, cost can be reduced due to the reduced number of parts.

On the other hand, in an invention disclosed in claim 2, the rotation speed of the net body can be regulated easily to a desired speed. Moreover, the rotation direction of the net body can be easily made opposite to the rotation direction of the rotating blades. The rotation speed of an electric motor used in an invention disclosed in claim 2 may be variably-regulated by an inverter and the like or may be fixed at a certain speed. When adopting a fixed rotation speed, a desired rotation speed may be obtained by using a reducer.

In an invention disclosed in claim 3, the net body is supported and fixed by a first ring member, a second ring member and rods, and they rotate in an integrated fashion as one rotating structure. Accordingly, it is easy to locate the net body rotatably. More specifically, it is realized, for example, as a structure in which a first ring member is supported by rollers as disclosed in claim 4 or a structure in which a supported part (a hole to insert an axis) of a second ring member is supported by a supporting part of a cover member (supporting axis and the like) rotatably as disclosed in claim 5.

Particularly, it is preferable to adopt a structure in which the first ring member is supported at its outer circumference to make the most of the inner area of the first ring member as a particulates inlet since the inner area of the first ring member functions as a particulates inlet.

In an invention disclosed in claim 6, an electric motor is located on the outer surface of the cover member. This structure allows an effective utilization of the inner space.

LIST OF REFERENCES

Figure 1:
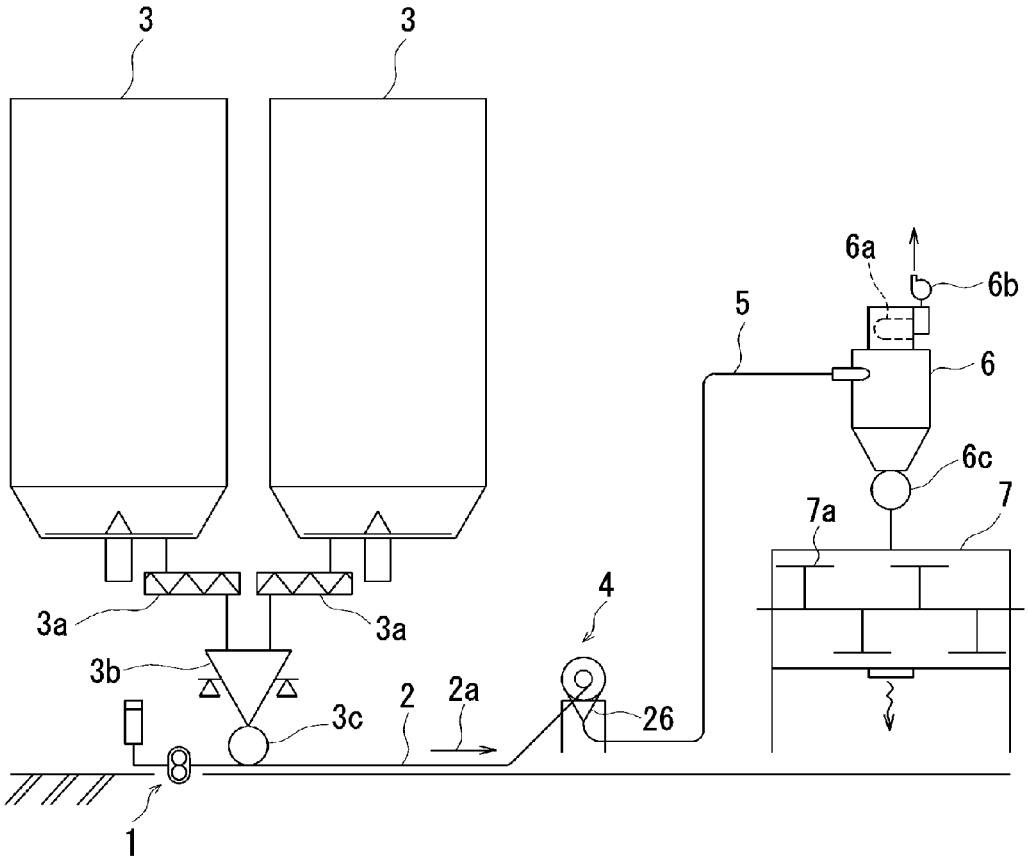
FIG. 1 shows a layout of particulate conveying facility that includes a particulate sifter 4 according to the first embodiment of the invention.

20 . . . sieve casing.
21 . . . sieve (rotating structure)
23 . . . rotating blades
26 . . . net body
27 . . . first ring member
28 . . . second ring member
29 . . . rod
45 . . . roller
45M . . . electric motor

BEST MODES OF CARRYING OUT THE INVENTION

Preferred embodiments of the present invention are discussed below with reference to drawings. There may be many modifications, changes, and alterations without departing from the scope or spirit of the main characteristics of the present invention. All changes within the meaning and range of equivalency of the claims are therefore intended to be embraced therein.

First Embodiment

A particulate sifter according to this embodiment of the invention is an inline type particulate sifter connected to a conveying line in a particulate conveying system shown in FIG. 1. Reference number 1 in FIG. 1 indicates an air supplying means that supplies conveying air (compressed air) into a pipe 2 in order to convey particulates pneumatically. Particulates discharged from stock bins 3 with screw conveyers 3*a* and measured with an automatic measuring apparatus 3*b* are injected into the pipe 2 via a rotary valve 3*c* disclosed in Japanese Patent No. 3336305 and others. The injected particulates are then mixed with the conveying air and conveyed in the pipe 2 as particulate-air mixture in the direction of the arrow 2*a*.

A particulate sifter 4 to screen and remove foreign substances in the particulate-air mixture is connected to the pipe 2 at the downstream of rotary valve 3*c*. The particulate-air mixture from which foreign substances are removed flows into a server 6 via a pipe 5. The particulate-air mixture which has flowed into the server 6 is separated into conveying air and particulates with a filter 6*a*. The separated conveying air is exhausted into the air through a blower 6*b* located at the downstream of filter 6*a*. The separated particulates fall downward within the server 6 with their own weight to be discharged into a mixer 7 having agitating blades 7*a* via a rotary valve 6*c*. Particulates in the stock bins 3 are thus conveyed pneumatically to the mixer 7 after they are measured and foreign substances are removed therefrom.

Figure 2:
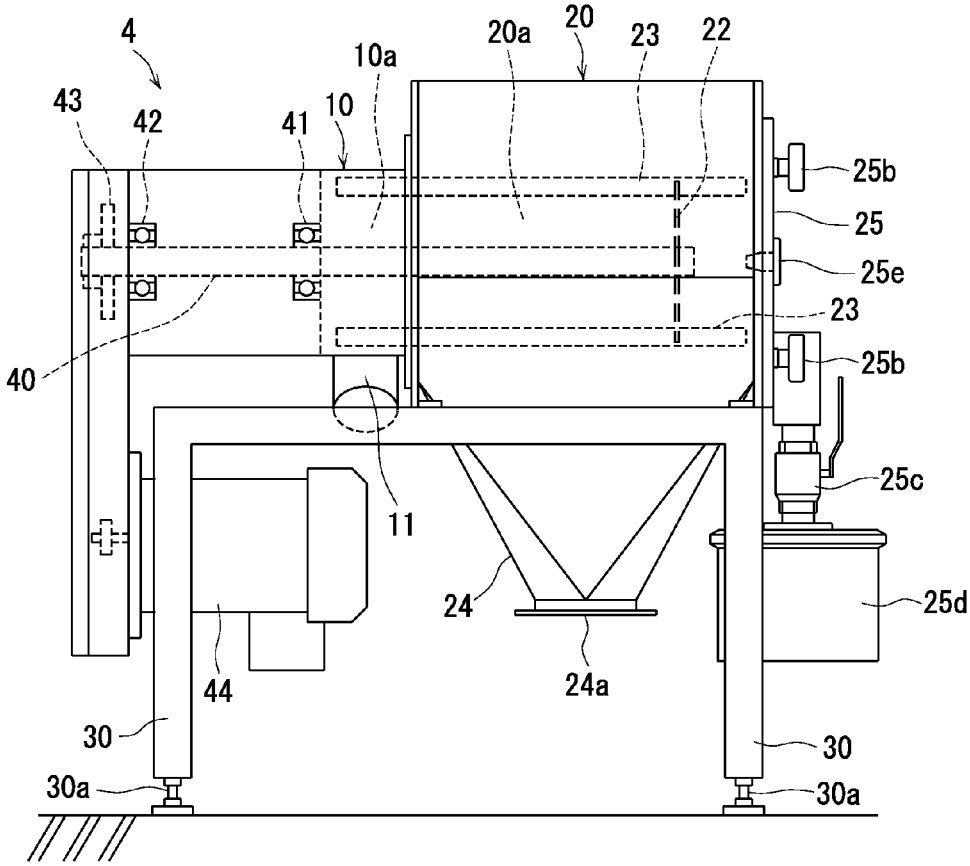
FIG. 2 shows a front view of the particulate sifter 4 shown in FIG. 1.
Figure 3:
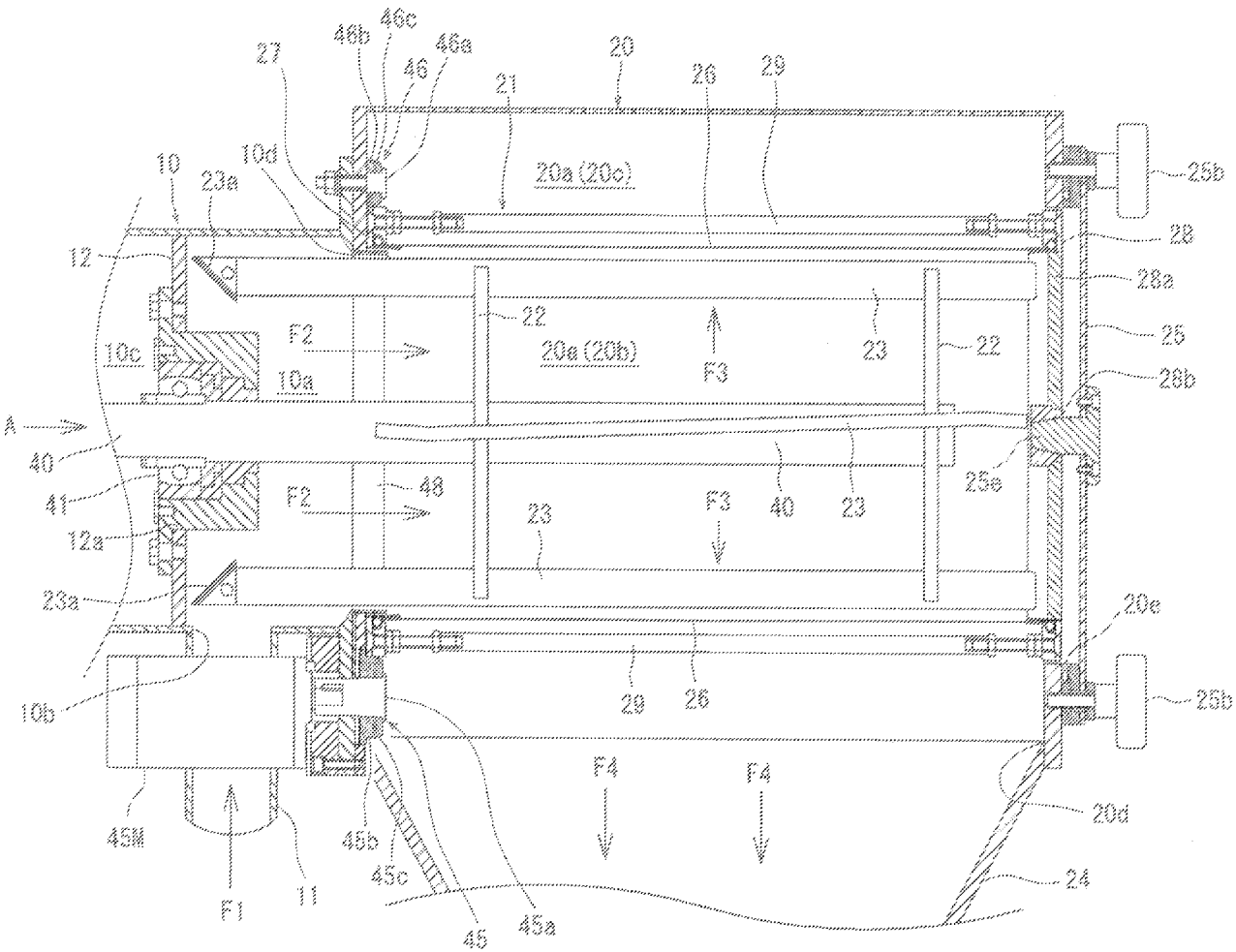
FIG. 3 shows a cross-sectional view of the particulate sifter 4 shown in FIG. 2

A structure of the particulate sifter 4 is described below with reference to FIG. 2 through FIG. 8. FIG. 2 is a front view of the particulate sifter 4. FIG. 3 is a cross-sectional view of the particulate sifter 4. The particulate sifter 4 has an influx casing 10 which forms a particulate-air mixture influx chamber 10*a* and a sieve casing 20 which forms sieving chamber 20*a* which communicates with the particulate-air mixture influx chamber 10*a*. The particulate-air mixture influx chamber 10*a* and the sieving chamber 20*a* are arranged side by side horizontally.

The sieve casing 20 in this embodiment corresponds to a casing in claims. In this embodiment, the influx casing 10 and the sieve casing 20 are formed of separate metal plates such as stainless plates, and these casings 10 and 20 are integrated together by welding. The influx casing 10 and the sieve casing 20 are located and supported on a mount 30 having supporting legs 30*a* which can be used to level the mount 30 by controlling the height of them.

On the influx casing 10, there is an influx hole 10*b* that allows the particulate-air mixture to flow in the particulate-air mixture influx chamber 10*a*. A particulate-air mixture inlet 11 that supplies the particulate-air mixture supplied from the pipe 2 after passing through the upstream air supplying means 1 and rotary valve 3*c* is connected to the influx hole 10*b*. The particulate-air mixture inlet 11 is a pipe having a circular cross-section. The influx hole 10*b* opens on the bottom side of the influx casing 10.

Figure 4:
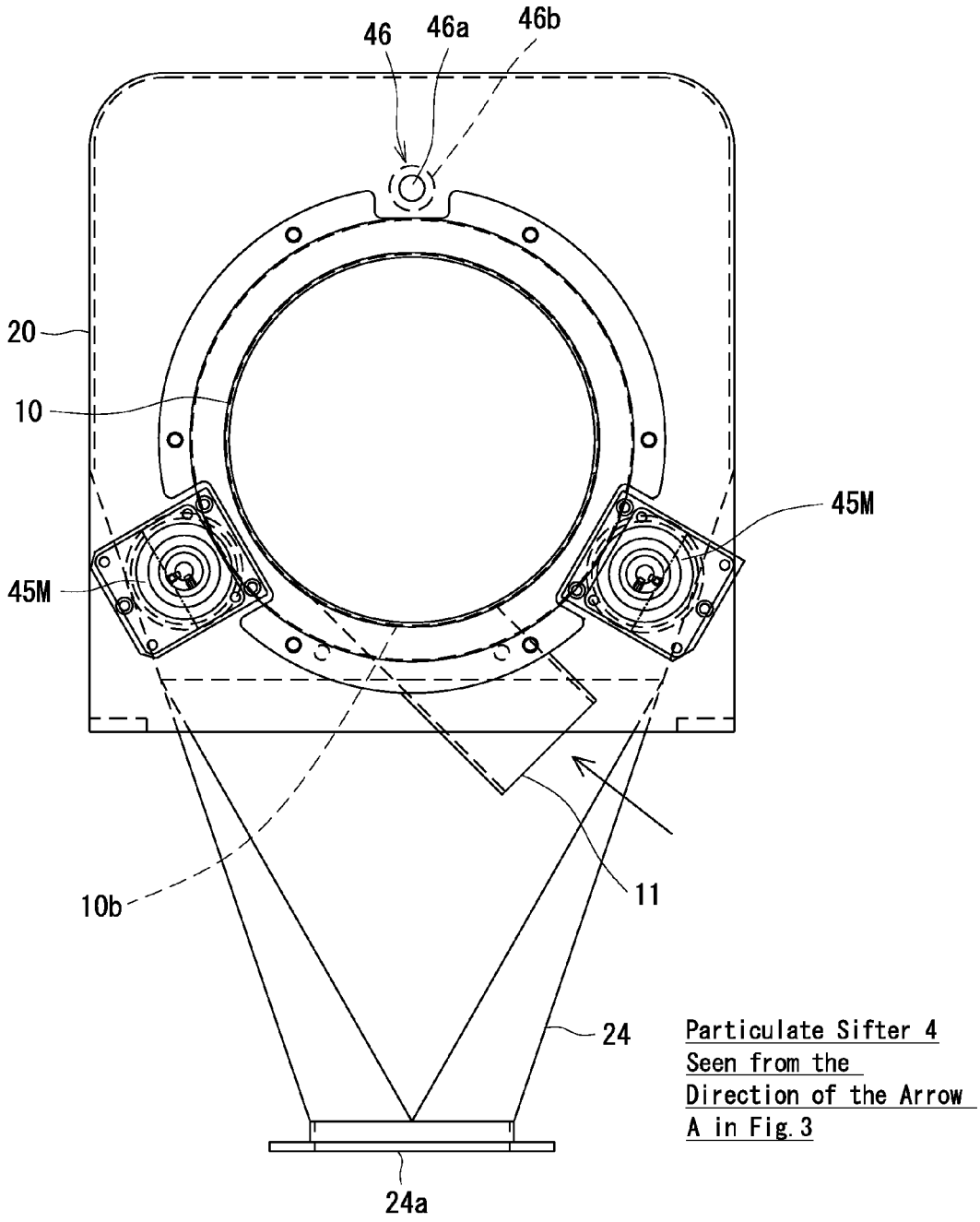
FIG. 4 shows the particulate sifter 4 seen from the direction of the arrow A in FIG. 3.

The influx casing 10 has a shape of a cylinder which extends in a horizontal direction (right and left directions in FIGS. 2 and 3). The particulate-air mixture inlet 11 is connected to the influx casing 10 in a direction of a tangential line of the outer circumference of the influx casing 10 as shown in FIG. 4 which shows the particulate sifter 4 seen from the direction of the arrow A in FIG. 3. The particulate-air mixture that has flowed into the particulate-air mixture influx chamber 10*a* thus circles along the inner circumference of the influx casing 10 before being conveyed into the sieving chamber 20*a*. In order to convey the particulate-air mixture in a manner described above, it is preferable that the injection angle of the particulate-air mixture inlet 11 against the particulate-air mixture influx chamber 10*a* is 45°. An injection angle of 0° to 90° is also possible depending on the injection location of the particulate-air mixture inlet 11 on the influx casing 10.

In the influx casing 10, there is a bearing housing chamber 10*c* separated from the particulate-air mixture influx chamber 10*a* by a partition wall 12. A rotating shaft 40 extends from the bearing housing chamber 10*c* to the particulate-air mixture influx chamber 10*a* and sieving chamber 20*a*. A shaft hole 12*a* for the rotating shaft 40 is formed in the partition wall 12. A first bearing 41 is attached in the shaft hole 12*a*. A second bearing 42 is attached to the end portion of the bearing housing chamber 10*c* opposite to the partition wall 12 (see FIG. 2). The rotating shaft 40 is supported rotatably by the first bearing 41 and the second bearing 42.

The first bearing 41 and the second bearing 42 are made as cartridge type units, the first bearing 41 having a labyrinth ring and an air purge not shown in the figures. Leak of the particulate-air mixture from the particulate-air mixture influx chamber 10*a* into the bearing housing chamber 10*c* is prevented by this structure. A pulley 43 is fixed on one end of the rotating shaft 40 as shown in FIG. 2. The rotating driving force of an electric motor 44 is transmitted to the pulley 43 via a belt not shown in the figure.

As shown in FIG. 3, a sieve 21, which is a rotating structure and has a purpose of screening particulates and/or foreign substances in the particulate-air mixture that has flowed into the sieving chamber 20*a* via a communicating route 10*d* between the influx casing 10 and the sieve casing 20, is located in the sieving chamber 20*a*. The sieve 21 has a shape of a cylinder extending in a horizontal direction, and is located concentrically with the rotating shaft 40 which runs through the center of it.

The sieving chamber 20*a* has an approximate double cylinder structure divided into the inner area 20*b* of the sieve 21 and the radially outer area 20*c*, the inner area 20*b* communicating with the particulate-air mixture influx chamber 10*a*. The structure of the sieve 21 will be described in detail later.

The rotating shaft 40 is supported at one end by the first bearing 41 and the second bearing 42, with another free end projecting in the sieving chamber 20*a* to the vicinity of the right end portion of the sieve 21. A booster 22, 23 is integrally formed around the rotating shaft 40 as shown in FIG. 3. The booster 22, 23 extending within the inner area 20*b* of the sieve 21 rotates together with the rotating shaft 40 and thus functions as an amplifier of a wind force.

The booster is composed of radially shaped elements 22 and rotating blades 23. Multiple (two in this embodiment) radially shaped elements 22 are provided on both end portions within the inner area 20*b* of the rotating shaft 40 in order to support the rotating blades 23. Each rotating blade is a longitudinal plate member fitted and fixed to each tip of these radially shaped elements 22 and extends inclining several degrees (for example, 3° to 7°, preferably 5°) against the axial direction of the rotating shaft 40. The wind force of the particulate-air mixture that has flowed from the particulate-air mixture influx chamber 10*a* to the inner area 20*b* of the sieve 21 is amplified by this inclination.

A gap is formed between each rotating blade 23 and the inner circumference of the sieve 21. Each rotating blade also functions as a plate scraper to scrape particulates out the inner area 20*b* to the outer area 20*c* via the sieve 21. Multiple (four in this embodiment) rotating blades 23 are located symmetrically, with the same angle (90° in this embodiment) between them. Furthermore, one end portion 23*a* of the each rotating blade 23 in the particulate-air mixture influx chamber 10*a* is formed in a shape of a cutter (for example, in triangle).

Under particulate is defined as a particulate that has passed through the sieve 21 and has flowed into the outer area 20*c*. An under particulate exit 20*d* opens at the bottom part of the sieve casing 20 in order to discharge under particulates. A particulate-air mixture outlet 24 is connected to the under particulate exit 20*d*. The outlet 24 is formed in a shape of a hopper, and functions to gather under particulates into a pipe 5 which is connected to the exit 24*a* of the outlet 24.

Over particulate is defined as a particulate that has been conveyed within the inner area 20*b* in a direction of the rotating shaft 40 without passing through the sieve 21. An over particulate exit 20*e* opens on one side portion of the sieve casing 20. An access door 25 as a cover member is located on the over particulate exit 20*e*. The access door 25 is connected to the sieve casing 20 at one side via a hinge 25*a* (see FIG. 7), and is fixed to the sieve casing 20 at multiple points with knobs 25*b* having screw portion. The access door 25 can be thus opened in a horizontal direction by removing these knobs 25*b*. By opening the access door 25, it is possible to check inside the sieve casing 20, or to attach or detach the sieve 21 to or from the sieve casing 20.

The access door 25 also has a foreign substance exit not shown in figures, which opens toward the sieving chamber 20*a*. As shown in FIG. 2, the foreign substance exit communicates with a foreign substance receiver can 25*d* via a valve 25*c* although these are not shown in FIG. 3. Over particulates and/or foreign substances remaining in the sieve 21 are thus discharged from the foreign substance exit and stored in the foreign substance receiver can 25*d*.

The check valve provided between the foreign substance exit and the foreign substance receiver can 25*d* functions as a safety valve. The safety valve opens when the pressure applied by the pneumatically conveyed particulate-air mixture from sieving chamber 20*a* is above a predetermined pressure. Thus the safety valve opens and over particulates or foreign substances remaining in the sieve 21 are discharged automatically when the pressure applied from sieving chamber 20*a* is above a predetermined pressure. As a result, it is possible to remove particulates or foreign substances remaining inside the sieve 21 without opening the access door 25 to make the inside of the sieve 21 clean again. A detailed structure is described in WO02/38290A1.

Figure 5:
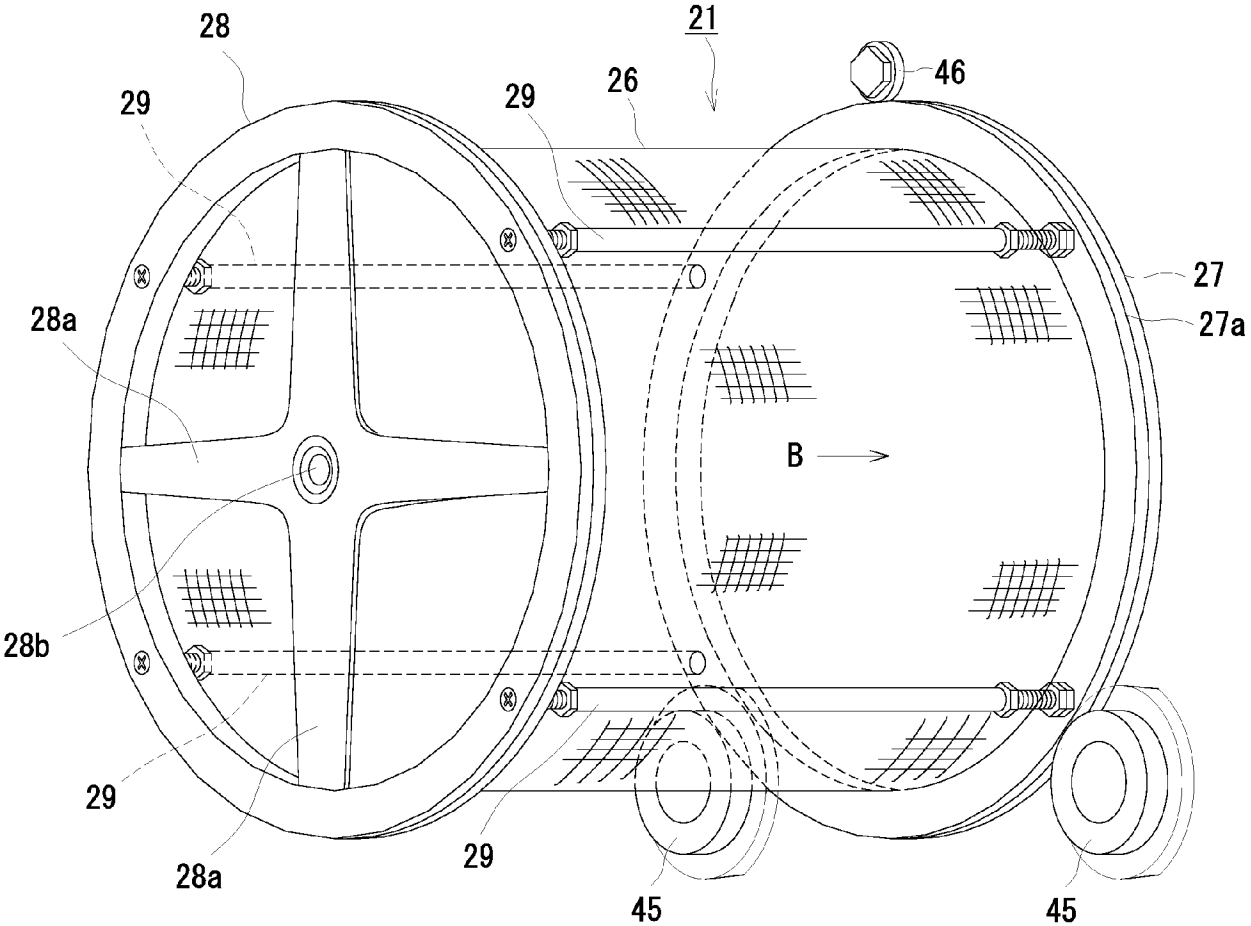
FIG. 5 shows a perspective view of the sieve 21 shown in FIG. 3.

The structure of the sieve 21 is described below with reference to FIG. 5 through FIG. 8. FIG. 5 shows a perspective view of the sieve 21 alone. The sieve 21 is comprised of a cylindrical net body 26 extending in a horizontal direction, a first ring member 27 which supports one of both ends of the net body 26 located on the side of the communicating route 10*d* (upstream side of the flow of particulates), a second ring member 28 which supports another end located on the side of the over particulate exit 20*e* (downstream side of the flow of particulates), and multiple (four in this embodiment) rods 29 which join the first ring member 27 and the second ring member 28.

It is preferable that the net body 26 is made of one of plastic and flexible substances including, for example, stainless steel and synthetic resin such as polyester. The net body 26 may be formed by knitting wires like a net or may be formed by molding a synthetic resin. The size of the net body 26 depends on intended purposes. In this embodiment, the mesh size of the net body 26 is set to about 0.5 mm×0.5 mm.

The first ring member 27 and the second ring member 28 have a shape projecting from the outer circumference of the net body 26, and these are made of stainless steel in this embodiment. The outer circumference 27*a* of the first ring member 27 is supported from the bottom direction by multiple (two in this embodiment) supporting rollers 45 rotatably attached to the sieve casing 20. A guide roller 46 facing upper portion of the outer circumference 27*a* of the first ring member 27 is also attached to the sieve casing 20 rotatably.

Figure 6:
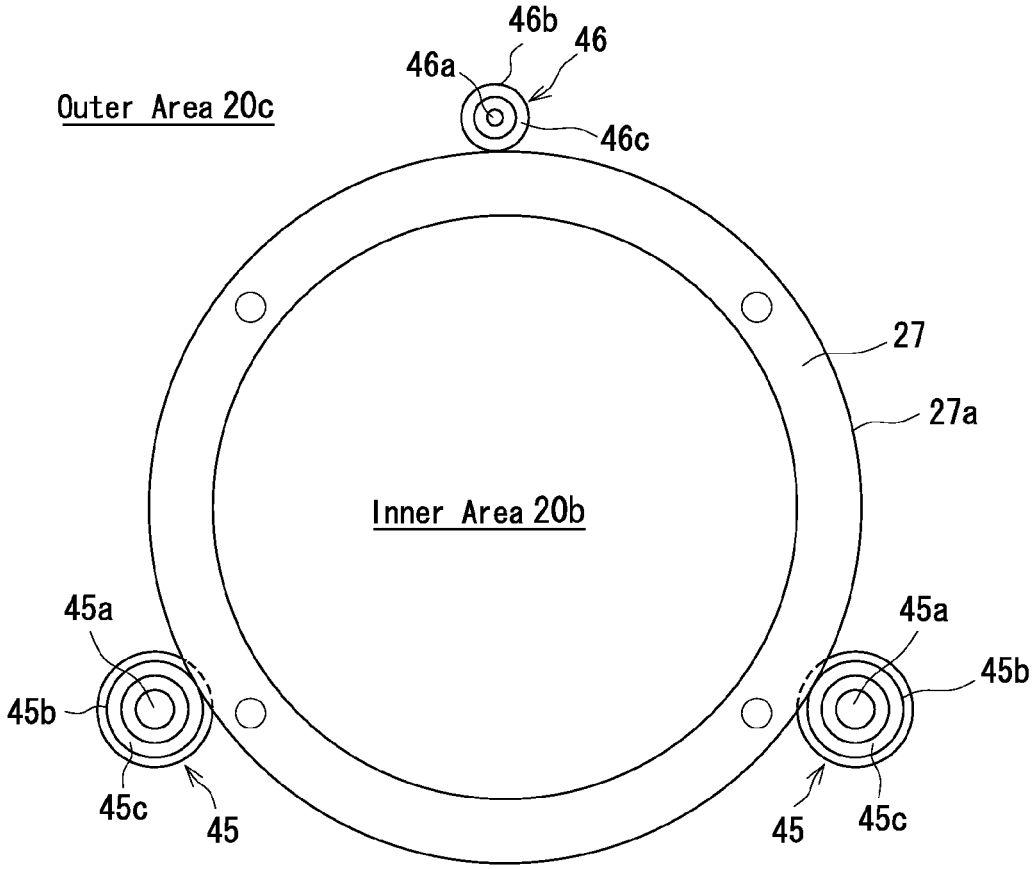
FIG. 6 shows the sieve 21 seen from the direction of the arrow B in FIG. 5, and particularly shows a first ring member 27, supporting rollers 45 and a guide roller 46.

FIG. 6 shows the first ring member 27, the supporting rollers 45 and the guide roller 46 seen from the direction of the arrow B in FIG. 5. Radial position of the first ring member 27 is regulated by the two supporting rollers 45 and one guide roller 46 as shown in FIG. 6. The first ring member 27 is thus located rotatably around the central axis of the cylindrical net body 26.

As shown in FIG. 3 and FIG. 6, the guide roller 46 is composed of a shaft member 46*a* fixed to the sieve casing 20 and a roller member 46*b* attached rotatably around the shaft member 46*a*. Each supporting roller 45 is composed of a driving shaft 45*a* rotated by an electric motor 45M shown in FIG. 3 and FIG. 4 and a roller member 45*b* which rotates integrally with the shaft member 45*a*. The electric motors 45M are attached on the outer surface of the sieve casing 20.

Figure 8:
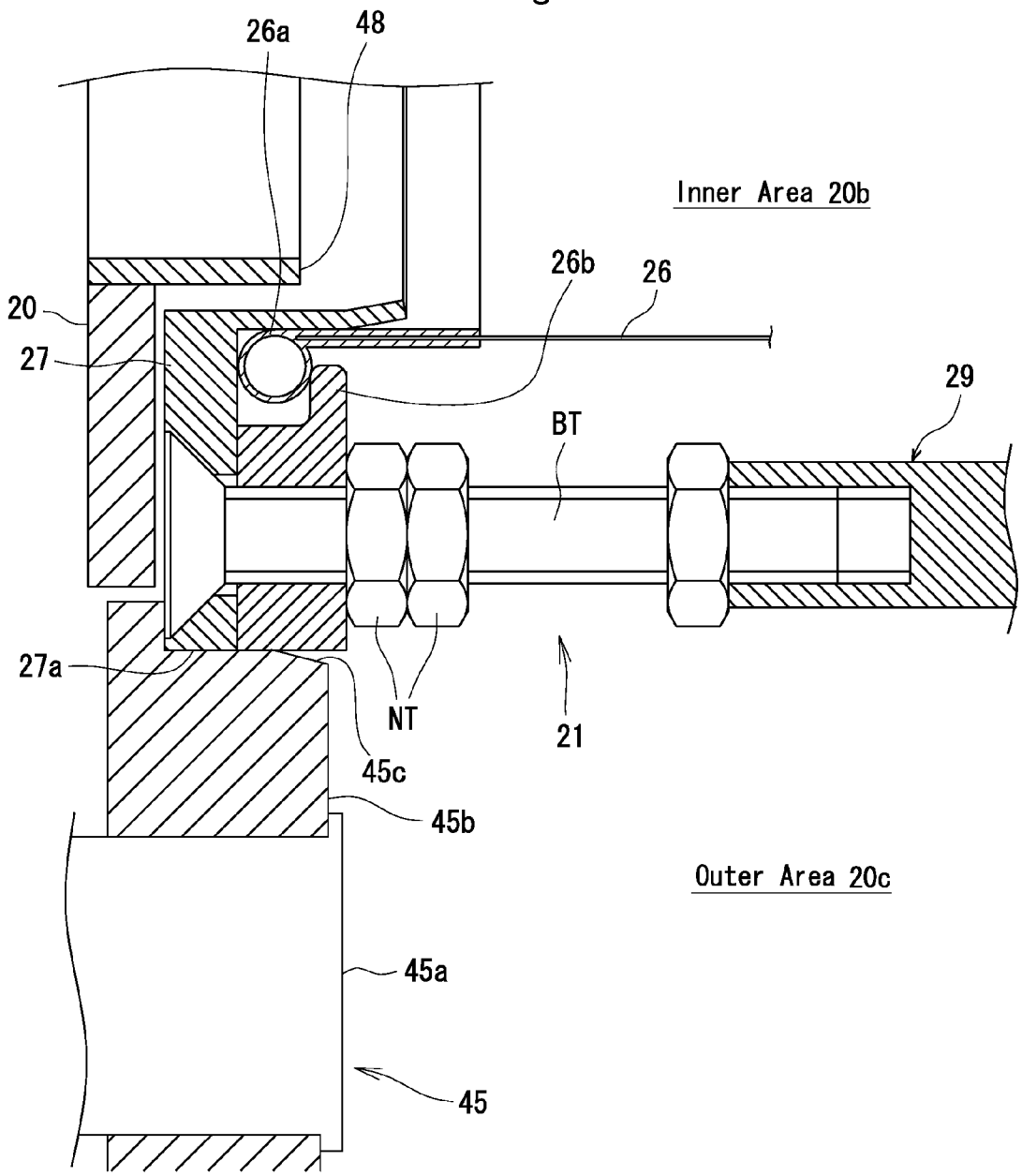
FIG. 8 shows a cross-sectional view to show a supporting structure of a first ring member 27.

As shown in FIG. 8, edge portions 45*c* and 46*c* of respective roller members 45*b* and 46*b* are formed in a tapered shape. This facilitates fitting the first ring member 27 within the three rollers 45, 46 when the sieve 21 is inserted and set to a predetermined position in the particulate-air mixture influx chamber 10*a*.

Figure 7:
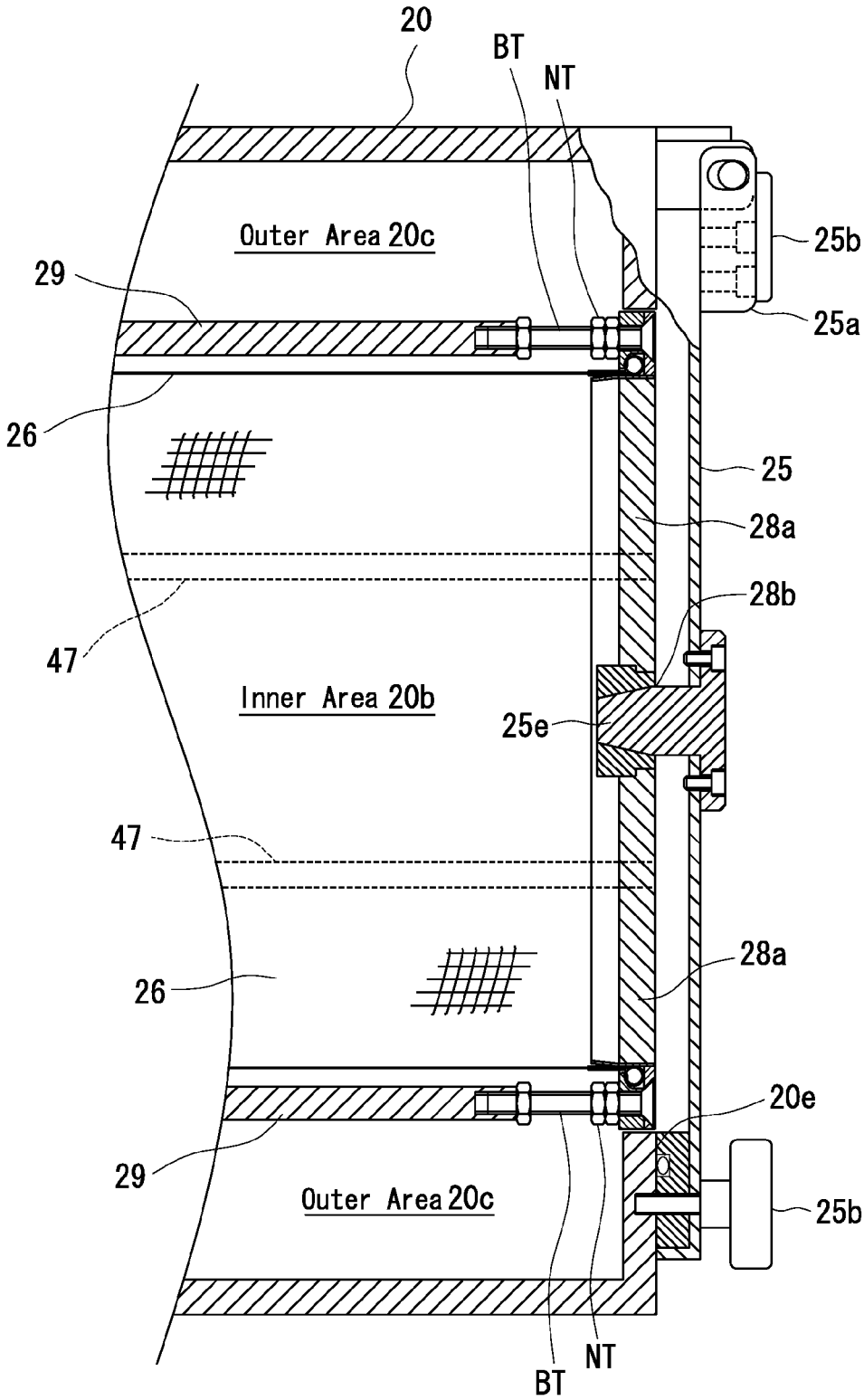
FIG. 7 shows a cross-sectional view to show a supporting structure of a second ring member 28.

Meanwhile, the second ring member 28 has a frame 28*a* in its inner area which extends in radial directions, the outer end portions of the frame 28*a* being fixed to the inner circumference of the second ring member 28 by means including welding. In this embodiment, the frame 28*a* is formed in a cross shape as shown in FIG. 5. FIG. 7 shows a cross-sectional view to show a supporting structure of a second ring member 28. As shown in FIG. 7, FIG. 3 and FIG. 5, a shaft hole 28*b* is formed in the frame 28*a* at the location corresponding to the central axis of the cylindrical sieve 21. A supporting shaft 25*e* to be inserted into the shaft hole 28*b* is attached to the access door 25 at the location corresponding to the central axis of the cylindrical sieve 21. The shaft hole 28*b* can thus rotates around the supporting shaft 25*e* as the driving shafts 45*a* rotate.

The second ring member 28 is thus located rotatably around the central axis of the cylindrical net body 26. The sieve 21 is thus also located rotatably within the sieving chamber 20*a*, as the first ring member 27 and the second ring member 28 are both supported rotatably. Furthermore, the sieve 21 can be rotated forcibly by the electric motors 45M as driving sources, by rotating the supporting rollers 45 using electric motors 45M.

Surfaces at which the shaft hole 28*b* and the supporting shaft 25*e* contact with each other are formed in a tapered shape. This allows a smooth insertion of the supporting shaft 25*e* into the shaft hole 28*b* when closing the access door 25 after locating the sieve 21 at a predetermined place within the sieving chamber 20*a*.

Meanwhile, reference number 47 in FIG. 7 indicates two guide rods extending in a direction parallel to the central axis of the cylindrical net body 26 (right and left direction in FIG. 7) beneath the sieve 21. These guide rods are used to move the sieve 21 with the first ring member 27 and the second ring member 28 sliding thereon when attaching and detaching the sieve 21 to and from the sieve casing 20 after opening the access door 25, and facilitate attaching and detaching of the sieve 21. When the first ring member 27 is fitted within the three rollers 45, 46, a certain gap exists between the first ring member 27 and guide rods 47, and between the second ring member 28 and guide rods 47, the gap size being set to a value suitable for preventing the interaction of the guide rods 47 and the rotating sieve 21.

FIG. 8 is a cross-sectional view to show a supporting structure of a first ring member 27. A cylindrical ring 48 extending along the inner surface of the first ring member 27 is attached to the sieve casing 20 by means including welding. A certain gap exists between the outer circumference of the cylindrical ring 48 and the inner surface of the first ring member 27, the gap size being set to a value suitable for preventing the interaction of the cylindrical ring 48 and the rotating sieve 21. This cylindrical ring 48 covers the gap between the first ring member 27 and the sieve casing 20, and thus prevents particulates from penetrating into the gap. The cylindrical ring 48 also has a function to reduce the damage of the sieve 21 when the first ring member 27 drops off the supporting rollers 45, as the sieve 21 falls on the upper portion of the outer circumference of the cylindrical ring 48 and drop length of the sieve 21 is reduced accordingly.

As shown in FIG. 8, a pair of ring projections is provided on both ends of the net body 26. Respective ends of the net body 26 are fixed to the first ring member 27 and to the second ring member 28 by clamping the respective ring projections 26*a* between the first ring member 27 and a holder frame 26*b* and between the second ring member 28 and a holder frame 26*b*, the holder frames 26*b* being a pair of circular ring-shaped frames that are movable and fixable along rods 29. More precisely, each holder frame 26*b* is movable against bolts BT as the holder frame 26*b* is inserted to bolts BT, and is fixable as it is fastened to the first ring member 27 by means of nuts NT.

Operation of the particulate sifter 4 of this embodiment is described below with reference to the arrows F1 to F4 shown in FIG. 3, which show how the particulate-air mixture flows.

First, the particulate-air mixture is supplied from the particulate-air mixture inlet 11 to the particulate-air mixture influx chamber 10*a* continuously from a tangential direction with the rotating shaft 40 and the booster 22, 23 rotating integrally due to the rotation of the electric motor 44 (see arrow F1). The particulate-air mixture injected from an outer circumference portion of the particulate-air mixture influx chamber 10*a* along the inner circumference of the particulate-air mixture influx chamber 10*a* flows spirally around the rotating shaft 40 toward the sieving chamber 20*a* forcibly (see arrow F2) and reaches to the inner area 20*b* of the sieve 21.

As the booster 22, 23 rotates at a high speed inside the sieve 21 due to the rotation of the rotating shaft 40, the rotating blades 23 agitate the particulate-air mixture. Once the booster 22, 23 begins to agitate the particulate-air mixture, clumps of particulates begin to break by agitation of the particulate-air mixture by the rotating blades 23 of the booster. Furthermore, clumps of particulates attached to the mesh of the net body 26 of the sieve 21 are scraped off by the rotating blades 23. The particulate-air mixture including under particulates finer than the mesh size of the net body 26 is sent out to the outer area 20*c* (see arrow F3), and then flows out to the pipe 5 (see FIG. 1) as a particulate-air mixture with conveying air via the under particulate exit 20*d*, the outlet 24 and the exit 24*a* (see arrow F4).

Meanwhile, over particulates and/or foreign substances bigger than the mesh size of the net body 26 comprised in the particulate-air mixture that has reached to the inner area 20*b* of the sieve 21 flows out from the inner area 20*b* to the foreign substance receiver can 25*d* via the foreign substance exit and the valve 25*c*, and they remain in the foreign substance receiver can 25*d*.

In this embodiment, two electric motors 45M rotate together with the electric motor 44 to rotate the respective supporting rollers 45. As a result, the sieve 21 rotates coaxially with the booster 22, 23 due to a friction between the outer circumferences of the supporting rollers 45 and the outer circumference 27*a* of the first ring member 27.

This rotation of the sieve 21 can prevent particulates from remaining on the outside of the net body 26. This prevention has following effects; propagation of microorganisms can be prevented, reduction of performance of the net body 26 can be prevented, loss of particulates after being measured at the measuring apparatus 3*b* can be reduced, particulates having a low flowability or a high cohesiveness can be shifted properly.

In this embodiment, the particulate-air mixture injected from the particulate-air mixture inlet 11 to the particulate-air mixture influx chamber 10*a* in a circumferential direction flows into the sieving chamber 20*a* after circling around the rotating shaft 40. Accordingly, the portion of the net body 26 to which the particulate-air mixture collides first when it flows into the sieving chamber 20*a* will receive more particulate-air mixture and more load than other portion. In this embodiment, however, the portion of the net body 26, which receives great load, changes with the rotation of the net body 26, as the sieve 21 is rotated. This prevents a local wear of a particular portion of the net body 26 and thus can result in a longer lifetime of the net body.

Second Embodiment

In the first embodiment described above, the invention is applied to an inline type particulate sifter 4 into which particulate-air mixture comprised of particulates and conveying air flows. On the other hand, in this embodiment, the invention is applied to a gravity type particulate sifter into which particulates are thrown by means of gravity without using conveying air.

Figure 9:
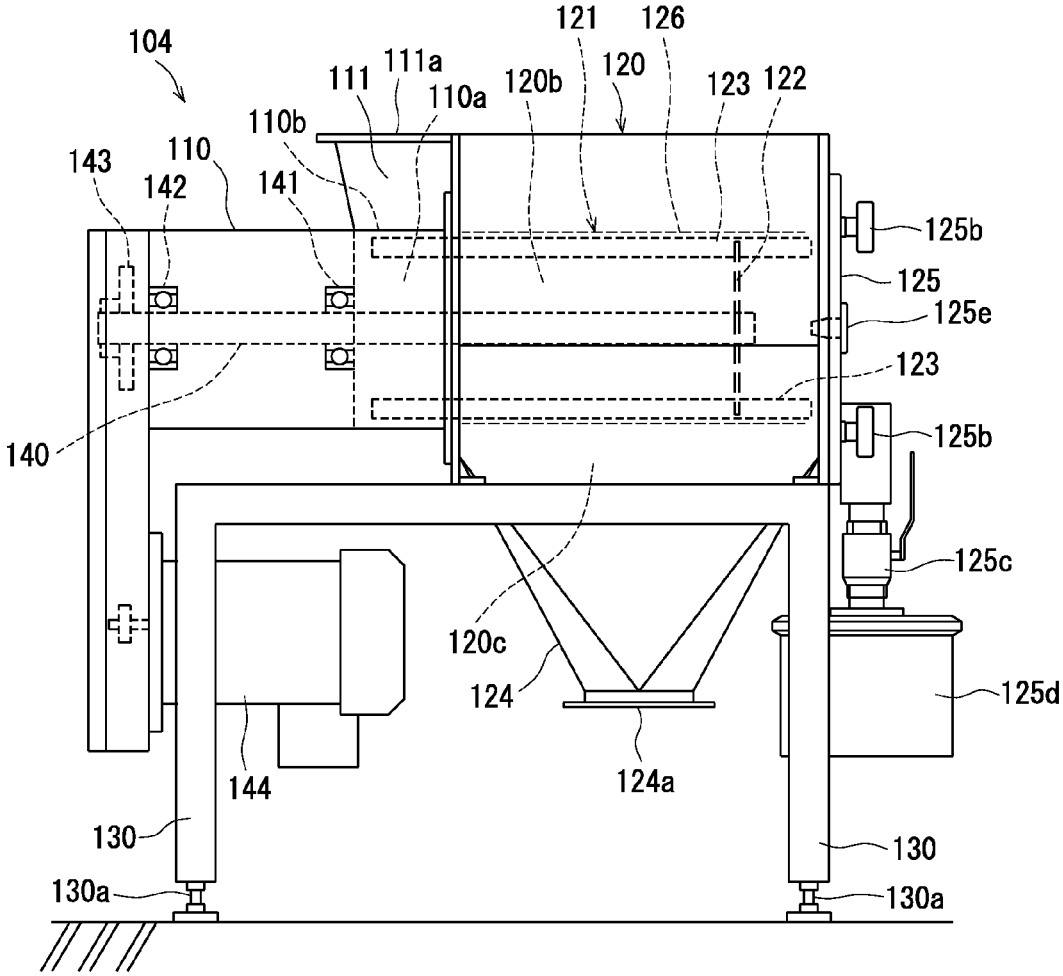
FIG. 9 shows a front view of a particulate sifter 104 according to the second embodiment of the invention.
Figure 10:
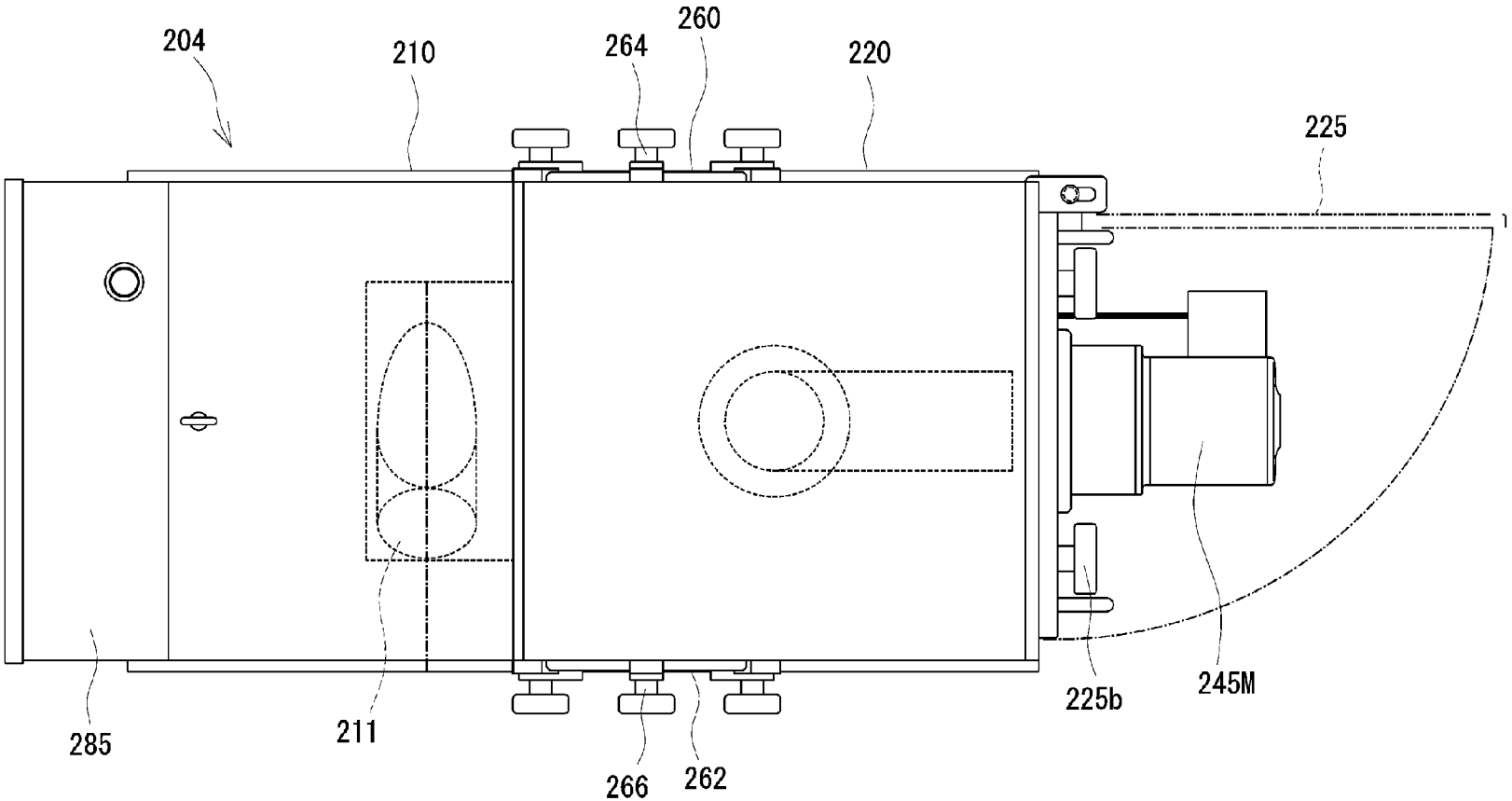
FIG. 10 shows an outer plan view of a particulate sifter 204 according to the third embodiment of the invention.
Figure 11:
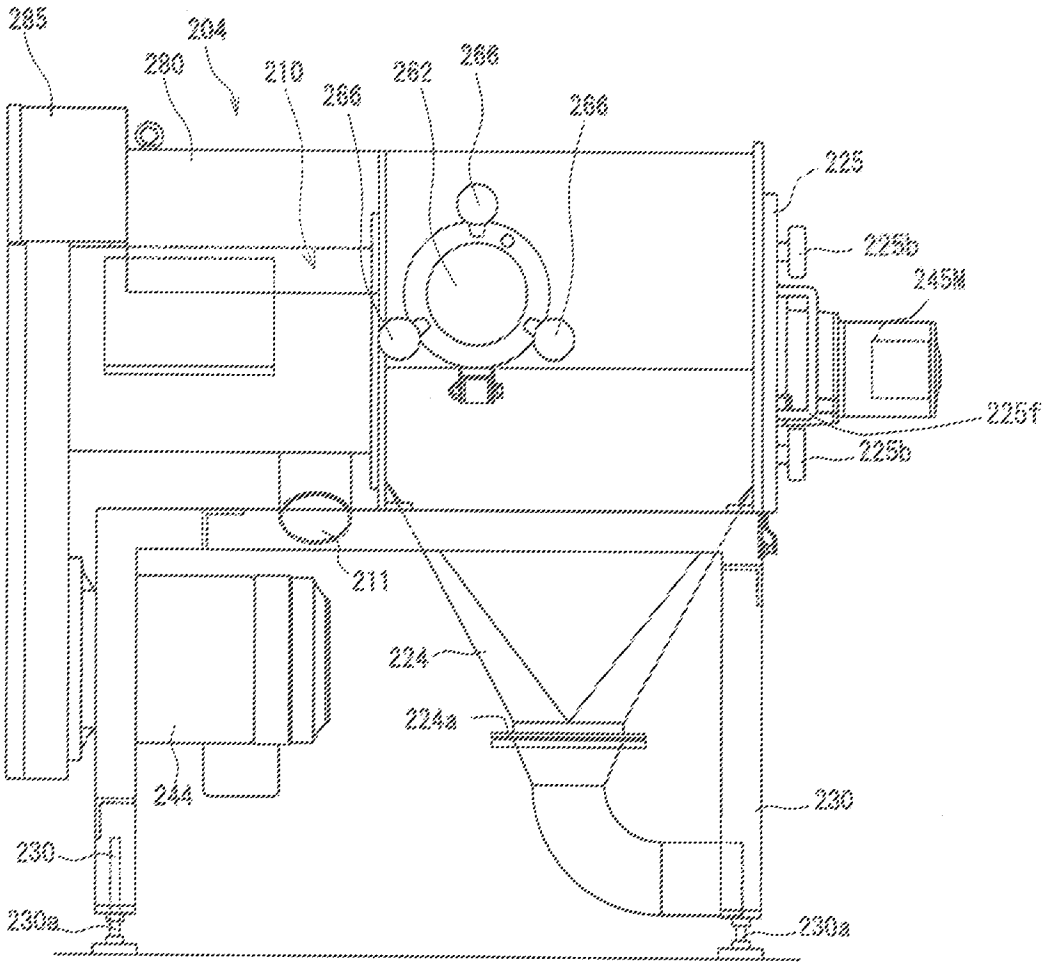
FIG. 11 shows an outer front view of the particulate sifter 204 shown in FIG. 10.
Figure 12:
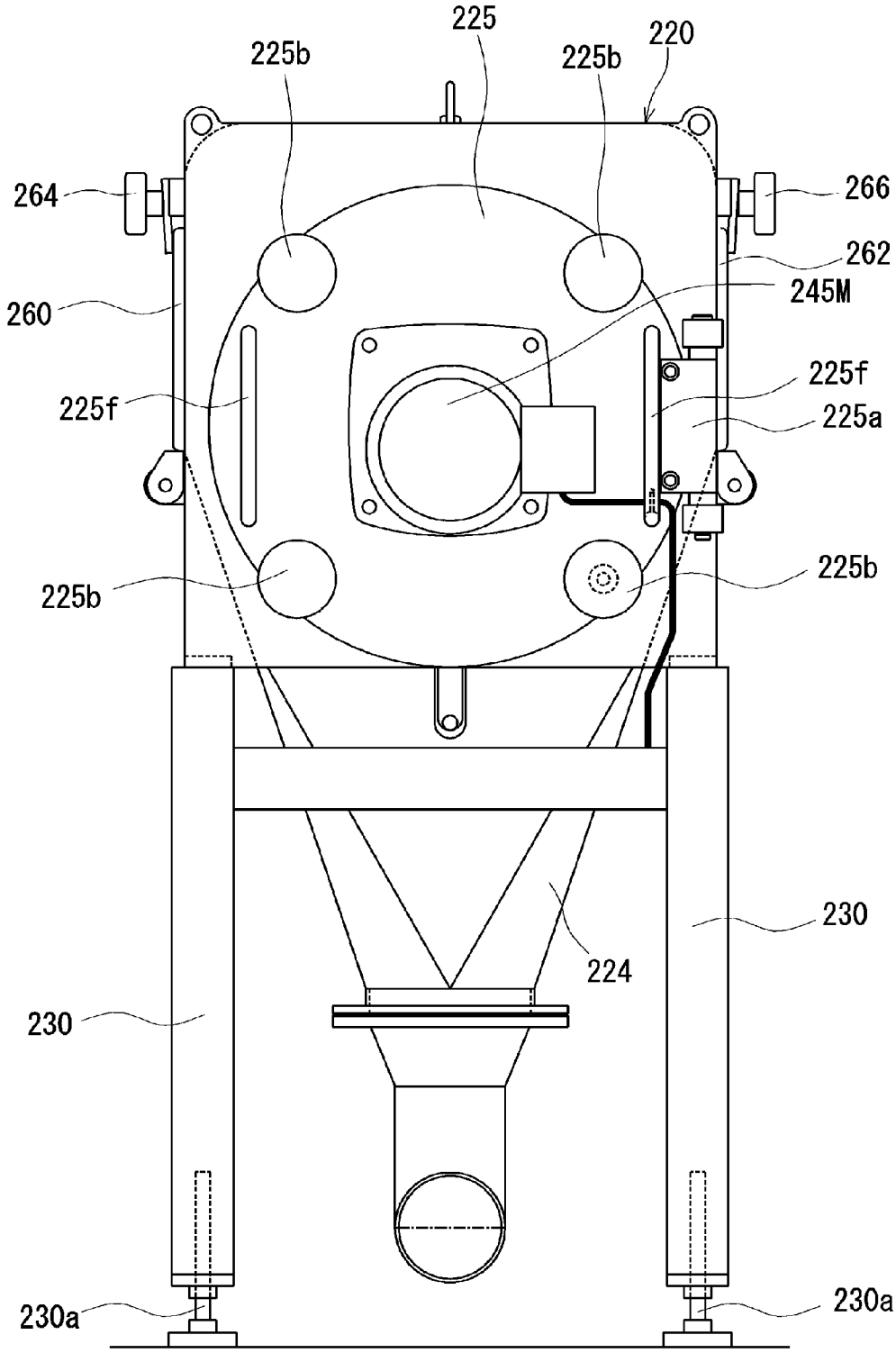
FIG. 12 shows an outer right side view of the particulate sifter 204 shown in FIG. 10.
Figure 13:
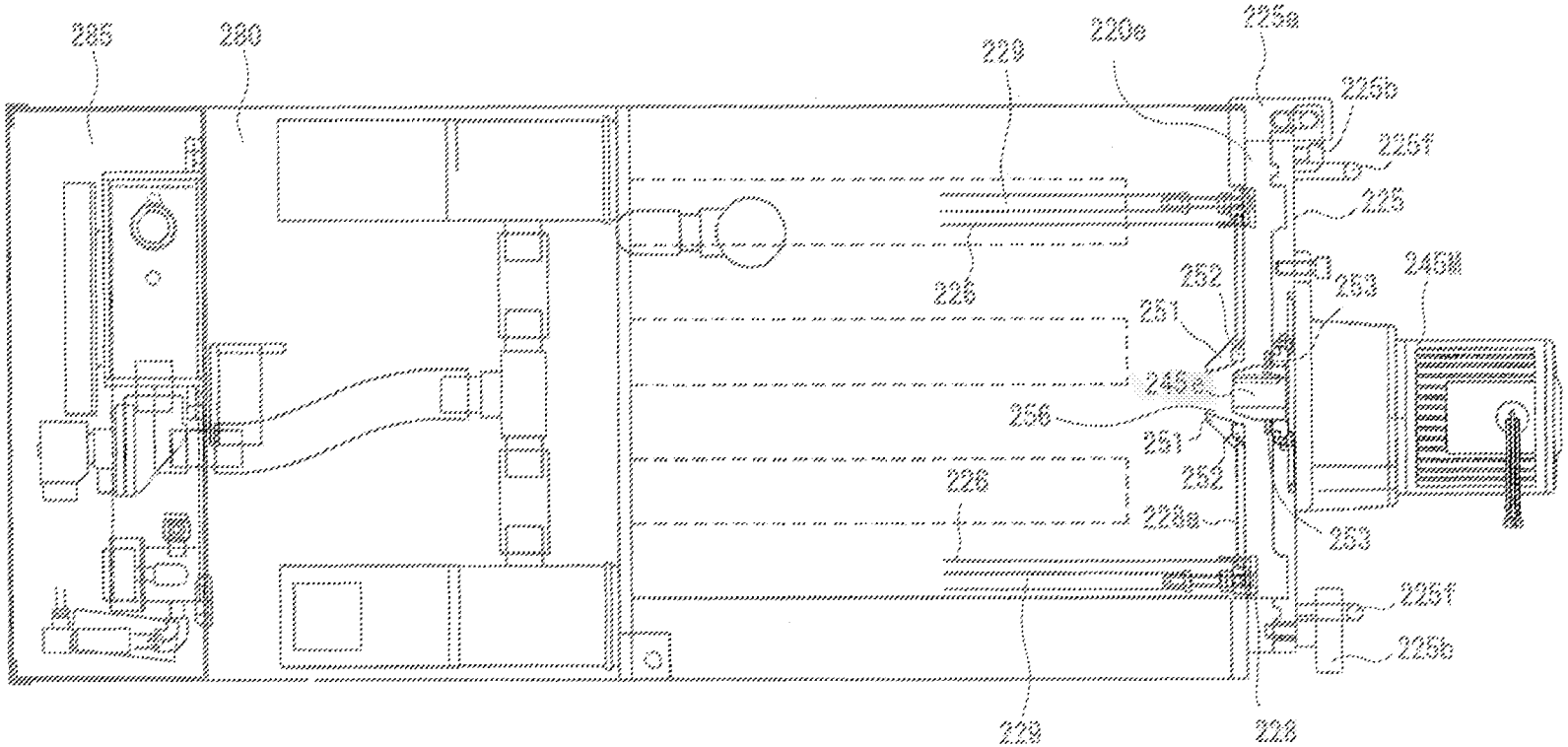
FIG. 13 shows an inner plan view of the particulate sifter 204 shown in FIG. 10.
Figure 14:
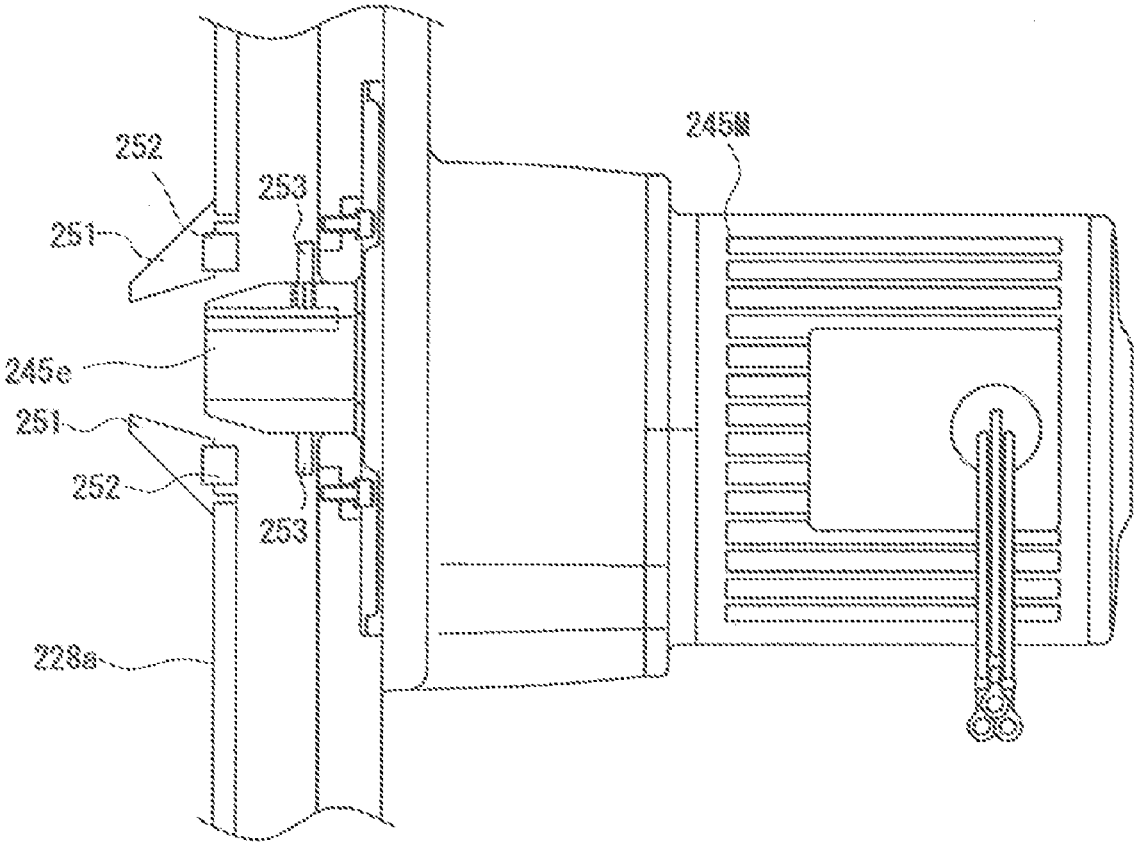
FIG. 14 shows an enlarged plan view of the electric motor and its vicinity from the particulate sifter 204 shown in FIG. 10.
Figure 15:
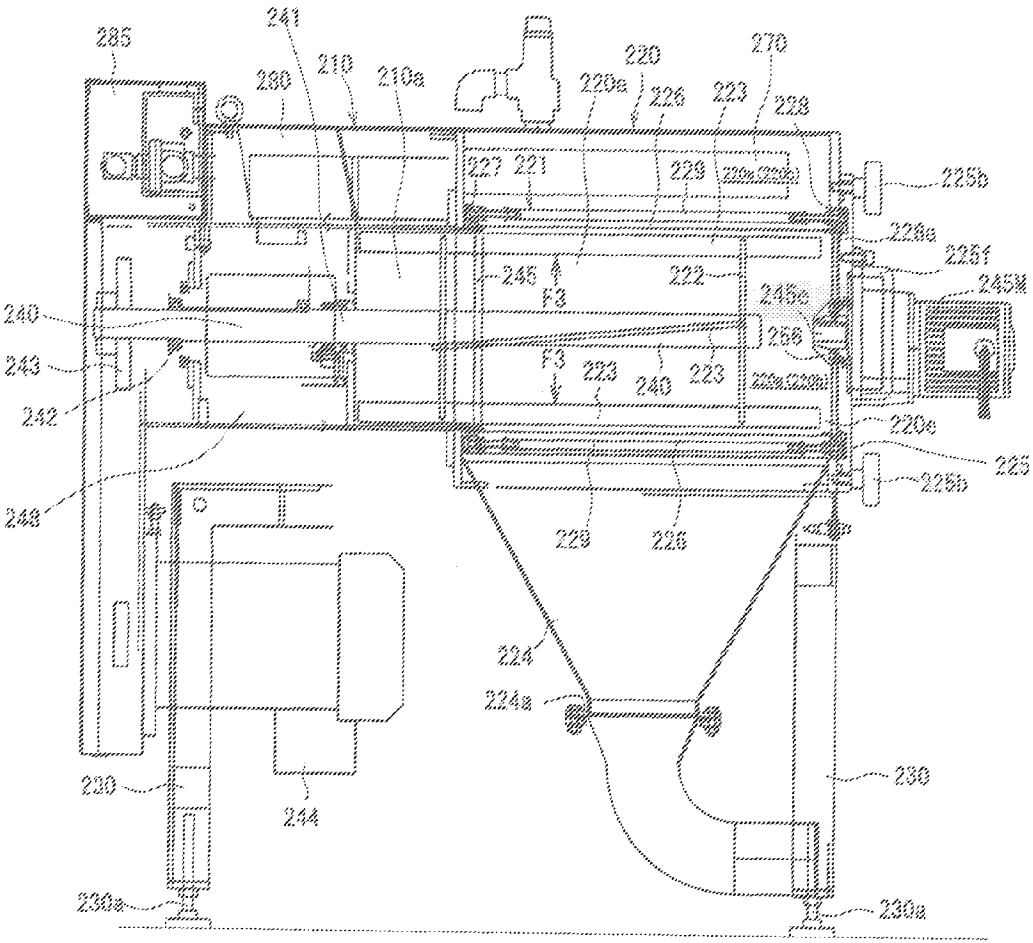
FIG. 15 shows an inner front view of the particulate sifter 204 shown in FIG. 10.

FIG. 9 shows a front view of a particulate sifter 104 according to this embodiment. Components of this embodiment corresponding to those of the first embodiment are numbered with 100 added to the reference number in the first embodiment. And a further explanation is omitted. Although the inlet 11 and the influx hole 10*b* are located on the bottom side of the influx casing 10 in the inline type particulate sifter 4, an inlet 111 and an influx hole 110*b* are located on the upper side of a influx casing 110 in a gravity type particulate sifter 104. The inlet 111 is formed in a shape of a hopper, and particulates are thrown in from a throw-in hole 111*a* of the inlet 111. Other components are similar to those in the first embodiment. Components which have similar functions are numbered with 100 added to those in the first embodiment, and detailed explanations on those components are omitted. As for the detailed structure, see Japanese Patent Laid-Open Gazette No. H3-131372, Japanese Patent Laid-Open Gazette No. H11-244784, Japanese Patent Laid-Open Gazette No. S63-69577 and others.

Operation of the particulate sifter 104 of this embodiment is described below. The throw-in hole 111*a* of the inlet 111 communicates with the atmosphere, and particulates thrown into a particulate-air mixture influx chamber 110*a* under an atmospheric pressure are sent to a sieving chamber 120*a* by the rotation force of rotating blades 123 extending to the particulate-air mixture influx chamber 110*a* and reach to the inner area 120*b* of a sieve 121.

The particulates are agitated inside the sieve 121 as a booster 122, 123 rotates at a high speed with the rotation of a rotating shaft 140.

Once the booster 122, 123 begins to agitate the particulates, clumps of particulates begin to break by agitation of the particulate-air mixture by the rotating blades 123. Furthermore, clumps of particulates attached to the mesh of a net body 126 of the sieve 121 are scraped off by the rotating blades 123. Under particulates finer than the mesh size of the net body 126 are thus sent out to the outer area 120*c*, and then fall downward to an outlet 124 and are discharged from an exit 124*a*.

Meanwhile, over particulates and/or foreign substances bigger than the mesh size of the net body 126 comprised in the particulates which have reached to the inner area 120*b* of the sieve 121 flows out from the inner area 120*b* to a foreign substance receiver can 125*d* via a foreign substance exit and a valve 125*c*, and they remain in the foreign substance receiver can 125*d*.

In this embodiment, two electric motors 145M (see FIG. 4) rotate together with an electric motor 144 to rotate respective supporting rollers 145. As a result, the sieve 121 rotates coaxially with the booster 122, 123. This can prevent particulates from remaining on the outside of the net body 126. This prevention have following effects; propagation of microorganisms can be prevented, reduction of performance of the net body 126 can be prevented, loss of particulates after being measured can be reduced, particulates having a low flowability or a high cohesiveness can be shifted properly. Furthermore, the portion of the net body 126, which receives great load, changes with the rotation of the net body 126. This prevents a local wear of a particular portion of the net body 126 and thus can result in a longer lifetime of the net body 126.

Third Embodiment

In the particulate sifter 4 of the first embodiment described above, the first ring member 27 of the net body 26 is supported and rotated by rollers 45 and 46 with the rollers 45 being rotated by the respective electric motors 45M. On the contrary, in a particulate sifter 204 of the third embodiment, location of an electric motor 245M is different from that of the electric motors 45M, and a second ring member 228 located at the downstream of a net body 226 is supported and rotated by the electric motor 245M. Furthermore, the rollers 45, 46 are replaced by a supporting member 245 shown in FIG. 16 and FIG. 17. This supporting member 245 is fitted inside a first ring member 227.

Figure 16:
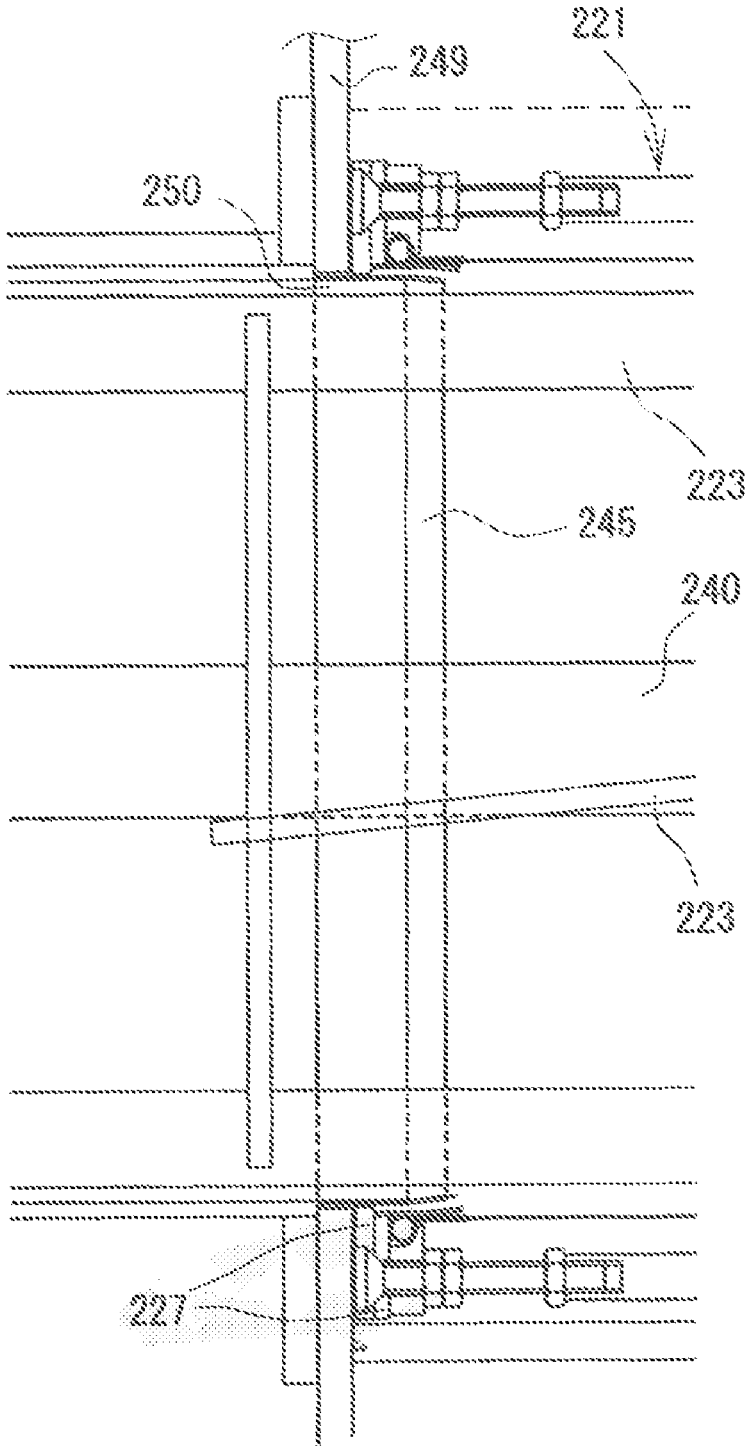
FIG. 16 shows a cross-sectional front view of an end portion of the sieve 221 and its vicinity from the particulate sifter 204 shown in FIG. 15.
Figure 17:
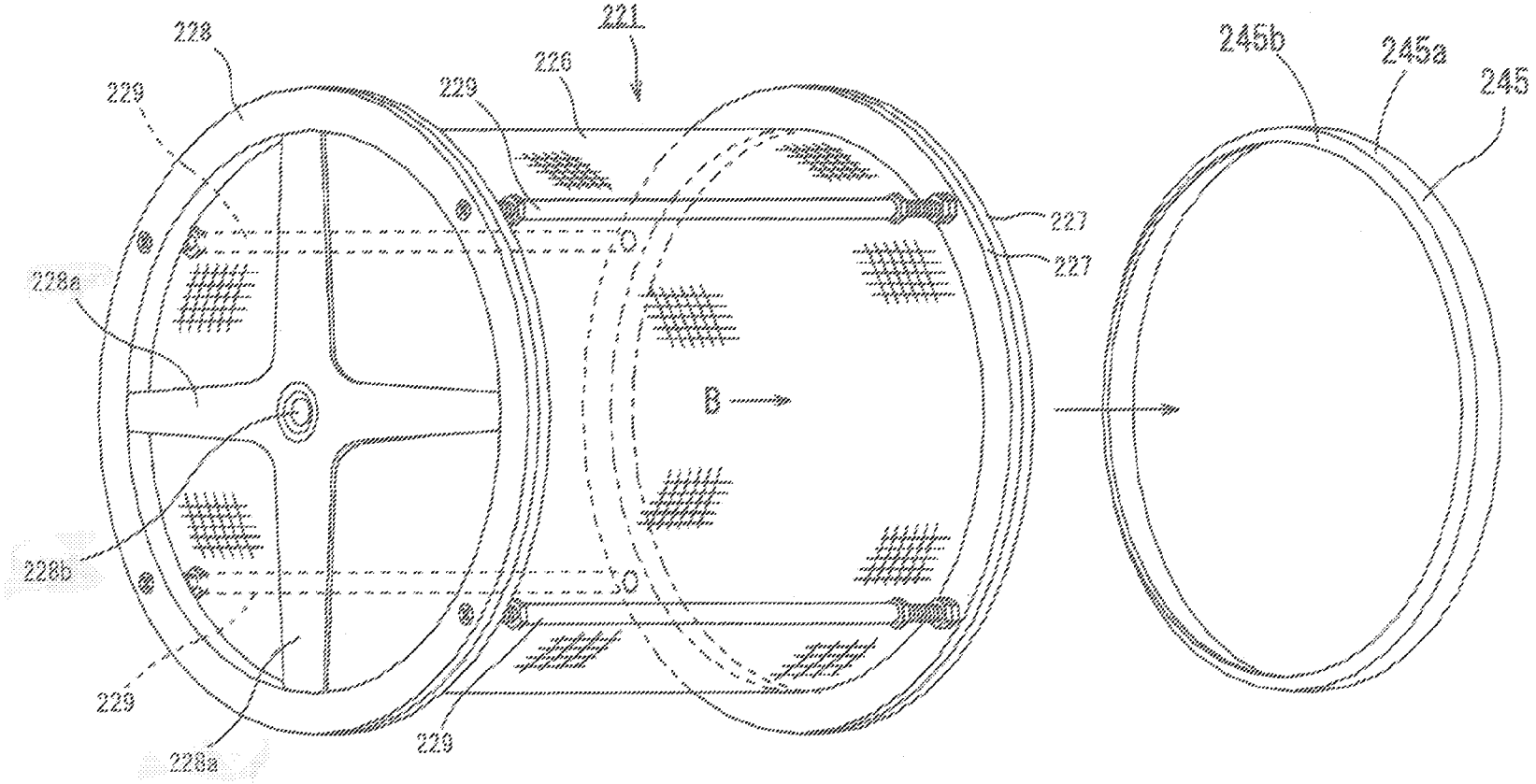
FIG. 17 is a perspective view showing how the sieve 221 of the particulate sifter 204 shown in FIG. 15 is fitted to a supporting member 245.
Figure 18:
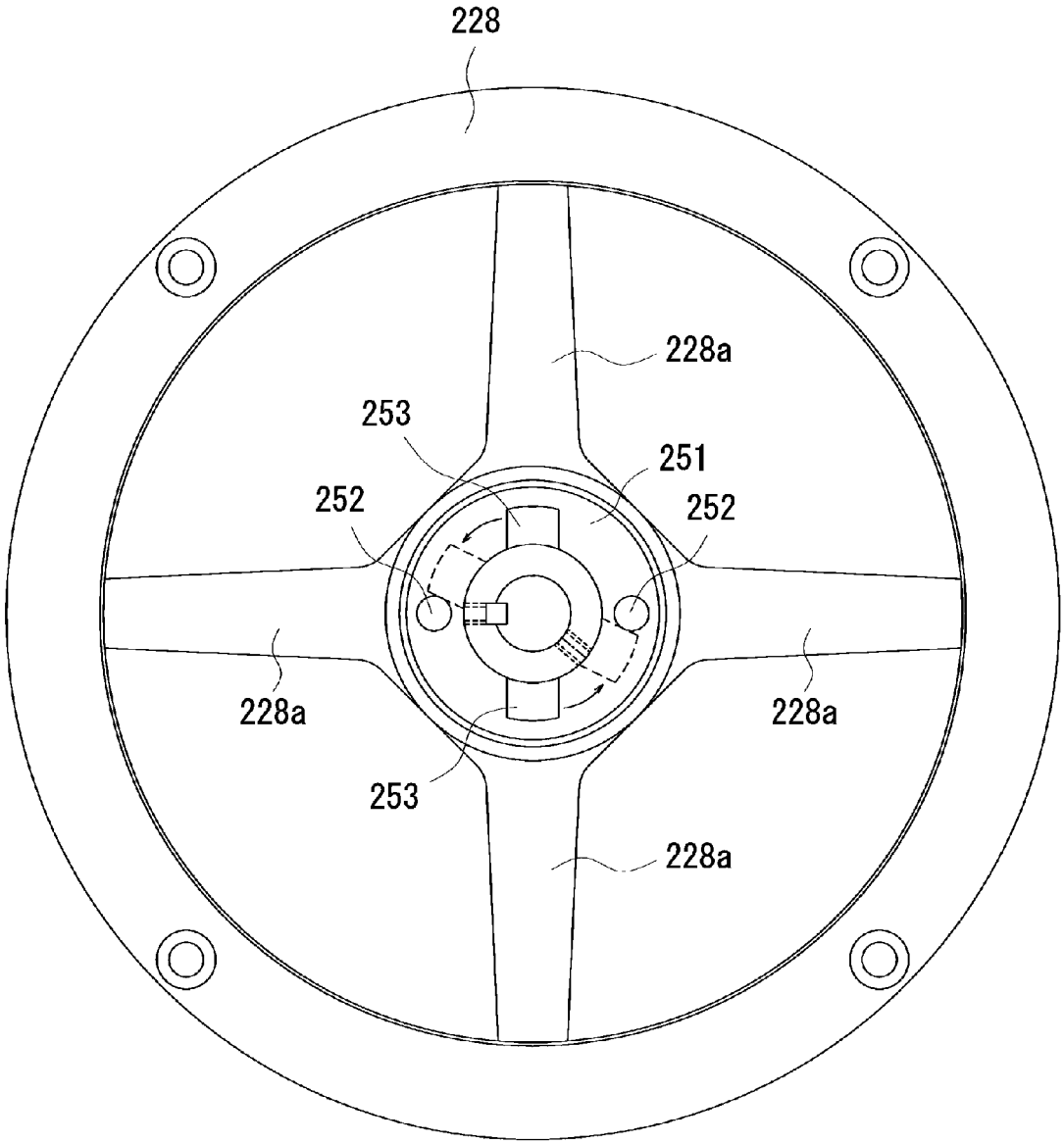
FIG. 18 is a right side view showing a positional relationship between a second ring member 228 and an end portion of the driving shaft of the particulate sifter 204 shown in FIG. 15.

More specifically as shown in FIG. 10 to FIG. 18, the particulate sifter 204 has an opening 220*e* located at one end of a casing 220 which is on the downstream side of the flow of particulates and an access door 225 to open and close the opening 220*e*. The electric motor 245M is fixed on the outer side of the access door 225. A net body 226 and a driving shaft 245*e* are engaged together. The particulate sifter 204 has a center member 251 which is joined to a frame 228*a* of the second ring member 228 and has a shaft hole 228*b* at its center and is located at the center of the second ring member 228, one or more pin(s) 252 projecting from the back side of the center member 251 in the back direction. The particulate sifter 204 also has one or more bar(s) 253 extended from the outer circumference of one end portion of the driving shaft 245*e*, and a dish-like concave 256 which has an opening at its center and engages with the end portion of the driving shaft 245*e*. The short cylindrical supporting member 245 is a plate substance having a shape of circle as shown in FIG. 16 and FIG. 17 and has continuous two planes of horizontal part 245*a* and inclining part 245*b*. The inclining part 245*b* inclines in a manner that the diameter becomes smaller toward the forward. A part of the outer circumference of the supporting member 245 is fixed to the inner circumference of a circular through-hole 250 in a vertical wall 249. The inclining part 245*b* is provided in order that the inner circumference of the first ring member 227 can be easily fitted to the outer circumference of the supporting member 245.

The first ring member 227 is supported by the supporting member 245 and rotates when the electric motor 245M operates in an operational status of the particulate sifter 204. Additionally, the bars 253 are engaged with the pins 252 as shown in arrows, of FIG. 18, because the bars 253 of the driving shaft 245*e* are rotated with the driving shaft 245*e* fitted in the concave 256 as the access door 225 is closed. This structure enables the integral rotation of the pins 252 and the bars 253 caused by the electric motor 245M and thus also enables the rotation of the net body 226. In other words, when the electric motor 245M begins to rotate after the access door 225 is closed, the pins 252 and the bars 253 are engaged and the net body 226 is rotated by the electric motor 245M. On the contrary, when the access door 225 is opened, the driving shaft 245*e* is detached from the net body 226, as the driving shaft 245*e* is detached from the concave 256 and the pins 252 are detached from the bars 253. Furthermore, one or more access door(s) 260, 262 are provided on the sieve casing 220. The sieve casing 220 can be closed and opened by locking and unlocking the access doors 260 and 262 with corresponding knobs 264 and 266. Knobs 225*f* are fixed on the outer surface of the access door 225. A filtering system, which is composed of a filter 270 and a filter controlling system 280, 285, is provided at the upper portion of an influx casing 210. The filter 270 is located inside and upper portion of the sieve casing 220 and is made of a retainer and a filter fabric covering the retainer. The filter controlling system 280, 285 controls separation of particulates and air by the filter 270 and back washing of the filter 270. As for the structure of the filtering system, see Japanese Patent No. 2634042, Japanese Patent Laid-Open Gazette No. 2000-157815, Japanese Patent Laid-Open Gazette No. 2001-62225. Other components are similar to those of the first embodiment. Corresponding components are numbered with 200 added to those of the first embodiment, and detailed explanation is omitted. This embodiment has similar effects as the first embodiment.

Other Embodiments (1) In the first to third embodiments described above, the sieve 21, 121 or 221 is rotated forcibly by respective motor 45M, 145M or 245M as driving sources. However, the supporting rollers 45 or 145 may be realized to rotate freely by omitting the driving source 45M or 145M in the first or second embodiment. In such a structure, the sieve 21 or 121 is rotated by the agitation of the particulate-air mixture by the rotating blades 23 or 123 (by the friction between the net body 26 or 126 and the particulates agitated by the rotating blades 23 or 123). This embodiment, therefore, has similar effects as the first or second embodiment, and also has a further effect of a cost-reduction due to the reduction of parts. The driving source 245M may be omitted and the supporting structure including the center member 251 may be replaced by a structure including a supporting shaft 25*e* and a shaft hole 28*b* according to the first embodiment in which the sieve 221 can rotate freely. On the other hand, when the sieve 21, 121 or 221 is rotated forcibly by the electric motor 45M, 145M or 245M, the rotation speed of the sieve 21, 121 or 221 can be easily set to a desired speed, moreover, the rotation direction of the sieve 21, 121 or 221 can be easily made opposite to that of the rotating blades 23, 123 or 223.

(2) In the first to third embodiments described above, the second ring member 28, 128 or 228 of the sieve 21, 121 or 221 is supported rotatably by the access door 25, 125 or 225 having the supporting shaft 25*e*, 125*e* or the driving shaft 245*e*. In a modified embodiment, the second ring member 28, 128 or 228 may be supported rotatably from the sieve casing 20, 120 or 220.

(3) In the first to third embodiments described above, the second ring member 28, 128 or 228 is supported by inserting the supporting shaft 25*e*, 125*e* or the driving shaft 245*e* into the shaft hole 28*b*, 128*b* or 251. However, the invention is not limited to such a structure. For example, the second ring member 28, 128 or 228 may be supported rotatably by rollers located around the outer circumference of the second ring member 28, 128 or 228.

(4) In the first to third embodiments described above, air is used as a conveying gas. However, nitrogen or other inert gases may be used to prevent oxidation of particulates.

(5) In the first to third embodiments described above, particulate sifters 4, 104 and 204 are used to remove foreign substances. However, they can be used to classify particulates according to particulate size.

(6) In the first embodiment described above, a particulate sifter 4 of the invention is applied to a particulate conveying system in which particulates measured automatically by an automatically measuring apparatus 3*b* are conveyed pneumatically. However, use of a particulate sifter of the invention is not limited to such an application. For example, a particulate sifter of this invention can be applied to a particulate conveying system in which particulates are thrown in from a manually feeding server 3*d* as shown in FIG. 19(*a*), or can be applied to a particulate conveying system in which particulates are packed after they have passed through the particulate sifter 4 as shown in FIG. 19(*b*).

Figure 19:
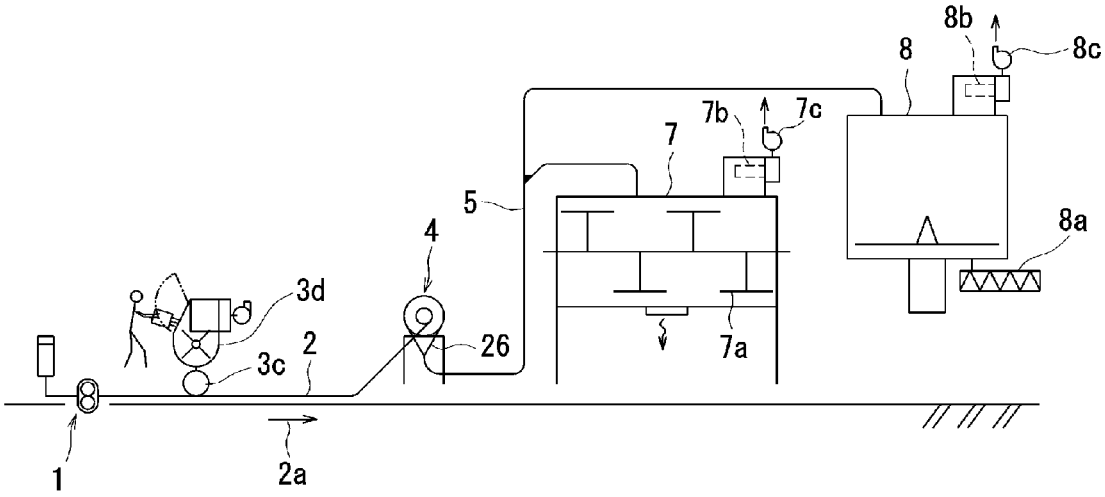
FIG. 19 shows layouts of particulate conveying system which show other examples of the invention.
Figure 19:
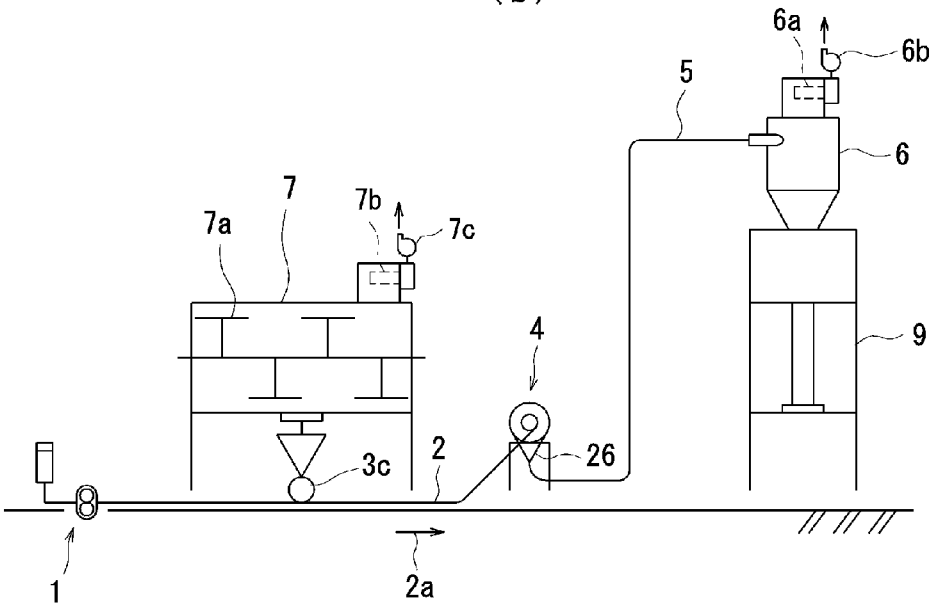
Figure 20:
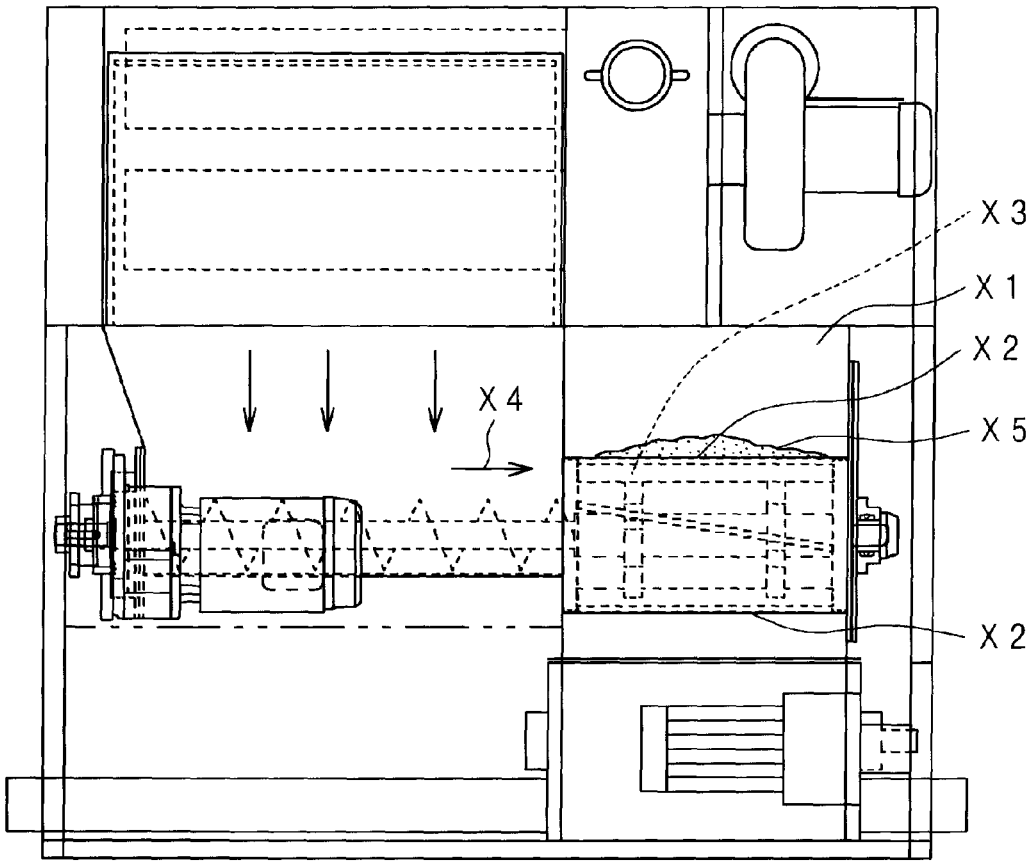
FIG. 20 is a front view of a particulate sifter disclosed in the Patent Document 1.

In the particulate conveying system shown in FIG. 19(*a*), particulate-air mixture, from which foreign substances are removed, flow into a mixer 7 or a storage tank 8 via a pipe 5 and is separated into conveying air and particulates by a filter 7*b* or a filter 8*b*. The conveying air after separation is discharged to the atmosphere from a blower 7*c* or a blower 8*c* located at downstream of the filter 7*b* or filter 8*b*. The particulates after separation fall downward with their own weight and then are discharged by a screw conveyer 8*a* or other devices. Particulates thrown in from the manually feeding server 3*d* are thus conveyed pneumatically to the mixer 7 or the storage tank 8 after the foreign substances in them are removed.

In the particulate conveying system shown in FIG. 19(*b*), particulates are thrown from a mixer 7 into a pipe 2 without being measured. Particulate-air mixture, after foreign substances in it are removed by a particulate sifter 4, flows into a server 6 via a pipe 5 and then is separated into conveying air and particulates by a filter 6*a*. The particulates after separation fall downward with their own weight and then are packed at a packer 9. The particulates thrown in from the mixer are thus conveyed pneumatically to the packer 9 after foreign substances in them are removed.

INDUSTRIAL APPLICABILITY

A particulate sifter according to this invention is applicable to a sieving system, a foreign substance removing system, a particulate conveying system, a particulate packing system and other systems.

What is claimed is:

1. A particulate sifter, comprising:

a casing into which particulates flow;

a cylindrical net body located inside said casing, said net body having two ends and extending in a horizontal direction;

a rotatable shaft forcibly rotatable by a first electric motor as a first driving source;

multiple radially shaped elements extending radially from said rotatable shaft and rotatable blades which are supported by said multiple radially shaped elements and are located inside said net body and extend in the direction of said rotatable shaft, and are positioned to rotate along an inner surface of the net body;

said sifter further comprising a rotatable structure, including: said net body;

a first ring member which supports one of the two ends of the net body and being located on an upstream side of a flow of the particulates;

a second ring member which supports the other of the two ends of the net body and being located on a downstream side of the flow of the particulates; and multiple rods which join said first ring member and said second ring member, wherein particulates that pass through said net body are seperable from particulates or foreign substances that do not pass through the net body while particulates that have flowed into the net body are agitated with said rotatable blades, and wherein one of said first and second ring members is supported and rotatable by a rotatable supporting member which is supported by said casing and is forcibly rotatable by a second electric motor as a second driving source, such that said rotatable structure is rotatable around said rotatable shaft independently of said rotatable shaft, and wherein said net body has a rotation center and said second ring member is provided with a frame in its inner area and a supported part located at the rotation center of the net body and rotatable with said second ring member;

said casing is provided with an opening used for taking the net body out of the casing and said opening is formed at a portion of the casing that faces said second ring member;

a cover member used for opening and closing said opening is provided with a supporting part which engages with said rotatable supported part; and said supporting part supports the rotatable supported part for rotation such that said rotatable structure is supported for rotation independently of said rotatable shaft.

2. The particulate sifter according to claim 1, wherein said first ring member has an outer circumference and is supported and rotatable at said outer circumference by said rotatable supporting member which is constructed as a supporting roller.

3. The particulate sifter according to claim 1 wherein said second electric motor is provided on said cover member;

said supporting part is identical to said supporting member and is constructed as a driving shaft of said second electric motor;

said driving shaft and said frame are provided with respective engageable and releaseable locking parts; and said second electric motor rotates the rotatable structure when said locking parts are in locking engagement.

* * * * *